US010175614B2

(12) United States Patent
Hozumi

(10) Patent No.: US 10,175,614 B2
(45) Date of Patent: Jan. 8, 2019

(54) BELT DEVICE, TRANSFER DEVICE, AND IMAGE FORMING APPARATUS

(71) Applicant: Yoshiki Hozumi, Kanagawa (JP)

(72) Inventor: Yoshiki Hozumi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/787,285

(22) Filed: Oct. 18, 2017

(65) Prior Publication Data

US 2018/0120739 A1 May 3, 2018

(30) Foreign Application Priority Data

Oct. 28, 2016 (JP) ..... 2016-211971

(51) Int. Cl.
*G03G 15/16* (2006.01)

(52) U.S. Cl.
CPC ..... *G03G 15/161* (2013.01); *G03G 15/168* (2013.01); *G03G 2215/1661* (2013.01)

(58) Field of Classification Search
CPC ..... G03G 15/161; G03G 15/168
See application file for complete search history.

(56) References Cited

U.S. PATENT DOCUMENTS 7,953,342 B2 * 5/2011 Nakamura ..... G03G 21/20 399/92
2006/0165450 A1 7/2006 Koike et al.
2006/0194662 A1 8/2006 Hozumi et al.
2007/0003336 A1 1/2007 Ninomiya et al.
2008/0063448 A1 3/2008 Hozumi et al.
2008/0069615 A1 3/2008 Shintani et al.
2008/0124117 A1 5/2008 Muraishi et al.
2008/0175635 A1 7/2008 Hozumi et al.
2009/0010692 A1 1/2009 Hozumi et al.
2009/0123205 A1 5/2009 Watanabe et al.
2009/0142083 A1 * 6/2009 Minbu ..... G03G 15/161 399/45
2010/0067945 A1 3/2010 Hozumi et al.
2010/0067949 A1 3/2010 Watanabe et al.
2010/0303495 A1 * 12/2010 Kurosu ..... G03G 15/2064 399/68

(Continued)

FOREIGN PATENT DOCUMENTS

JP 2005-308994 11/2005
JP 2006-267243 10/2006

(Continued)

*Primary Examiner* — Gregory H Curran
(74) *Attorney, Agent, or Firm* — Duft & Bornsen, PC

(57) ABSTRACT

A belt device includes a plurality of support rotators, a belt, a cleaner, and a rotator inclination unit. The belt is looped around the plurality of support rotators and moves according to rotation of the plurality of support rotators. The cleaner contacts a surface of the belt to remove foreign substances. The rotator inclination unit inclines an inclined support rotator that is at least one of the plurality of support rotators. The cleaner is disposed in contact with a portion of the belt stretched taut between the inclined support rotator and another support rotator. A pushing amount of the cleaner relative to the belt varies according to inclination of the inclined support rotator and is smallest in a state in which the inclined support rotator is not inclined by the rotator inclination unit.

10 Claims, 14 Drawing Sheets

(56) References Cited

U.S. PATENT DOCUMENTS

| | | | |
|---|---|---|---|
| 2011/0085834 | A1 | 4/2011 | Naruse et al. |
| 2011/0103822 | A1 | 5/2011 | Sugiura et al. |
| 2011/0158677 | A1 | 6/2011 | Kikuchi et al. |
| 2011/0229187 | A1 | 9/2011 | Hozumi et al. |
| 2011/0229234 | A1 | 9/2011 | Hozumi et al. |
| 2012/0008973 | A1 | 1/2012 | Sakakibara et al. |
| 2012/0034006 | A1 | 2/2012 | Asaoka et al. |
| 2012/0087704 | A1 | 4/2012 | Asaoka et al. |
| 2012/0099883 | A1 | 4/2012 | Kikuchi et al. |
| 2012/0224870 | A1 | 9/2012 | Kikuchi et al. |
| 2013/0315617 | A1 | 11/2013 | Sugiura et al. |
| 2014/0147181 | A1 | 5/2014 | Sugiura et al. |
| 2015/0090564 | A1 | 4/2015 | Iwaya et al. |
| 2015/0117896 | A1 | 4/2015 | Sugimoto et al. |
| 2015/0117914 | A1 | 4/2015 | Hozumi et al. |
| 2015/0125189 | A1 | 5/2015 | Hozumi et al. |
| 2015/0227089 | A1 | 8/2015 | Hozumi et al. |
| 2015/0301484 | A1 | 10/2015 | Hozumi et al. |
| 2016/0062279 | A1 | 3/2016 | Hozumi et al. |
| 2016/0139553 | A1 | 5/2016 | Hozumi et al. |
| 2016/0251166 | A1 | 9/2016 | Hozumi et al. |
| 2017/0242387 | A1 | 8/2017 | Hozumi et al. |

FOREIGN PATENT DOCUMENTS

| | | |
|---|---|---|
| JP | 2007-011107 | 1/2007 |
| JP | 2010-230958 | 10/2010 |
| JP | 2012-103286 | 5/2012 |
| JP | 2015-068874 | 4/2015 |
| JP | 2015-161941 | 9/2015 |
| JP | 2015-219483 | 12/2015 |

* cited by examiner

BELT DEVICE, TRANSFER DEVICE, AND IMAGE FORMING APPARATUS

CROSS-REFERENCE TO RELATED APPLICATION

This patent application is based on and claims priority pursuant to 35 U.S.C. § 119(a) to Japanese Patent Application No. 2016-211971, filed on Oct. 28, 2016, in the Japan Patent Office, the entire disclosure of which is hereby incorporated by reference herein.

BACKGROUND

Technical Field

This disclosure generally relates to a belt device, a transfer device, and an image forming apparatus, such as a copier, a printer, a facsimile machine, or a multifunction peripheral having at least two of copying, printing, facsimile transmission, plotting, and scanning capabilities.

Related Art

There are belt devices that include a belt that rotates in a state in which the belt is looped around a plurality of rollers, a belt cleaner, and a roller inclination unit that inclines a rotation axis of one of the plurality of rollers relative to that of other rollers.

When the belt is drawn to one side in the axial direction of the plurality of rollers around which the belt is looped (i.e., belt deviation occurs), one of the plurality of rollers is inclined by the roller inclination unit relative to the other rollers to move the belt in the direction opposite to the direction to which the belt has deviated. Furthermore, the belt device includes a brush roller as the cleaner. The brush roller is disposed in contact with a surface of a portion of the belt wound around a non-inclined roller.

SUMMARY

According to an embodiment of this disclosure, an improved belt device includes a plurality of support rotators, a belt, a cleaner, and a rotator inclination unit. The belt is looped around the plurality of support rotators and moves according to rotation of the plurality of support rotators. The cleaner contacts a surface of the belt to remove foreign substances. The rotator inclination unit inclines an inclined support rotator that is at least one of the plurality of support rotators. The cleaner is disposed in contact with a portion of the belt stretched taut between the inclined support rotator and another support rotator. A pushing amount of the cleaner relative to the belt varies according to inclination of the inclined support rotator and is smallest in a state in which the inclined support rotator is not inclined by the rotator inclination unit.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
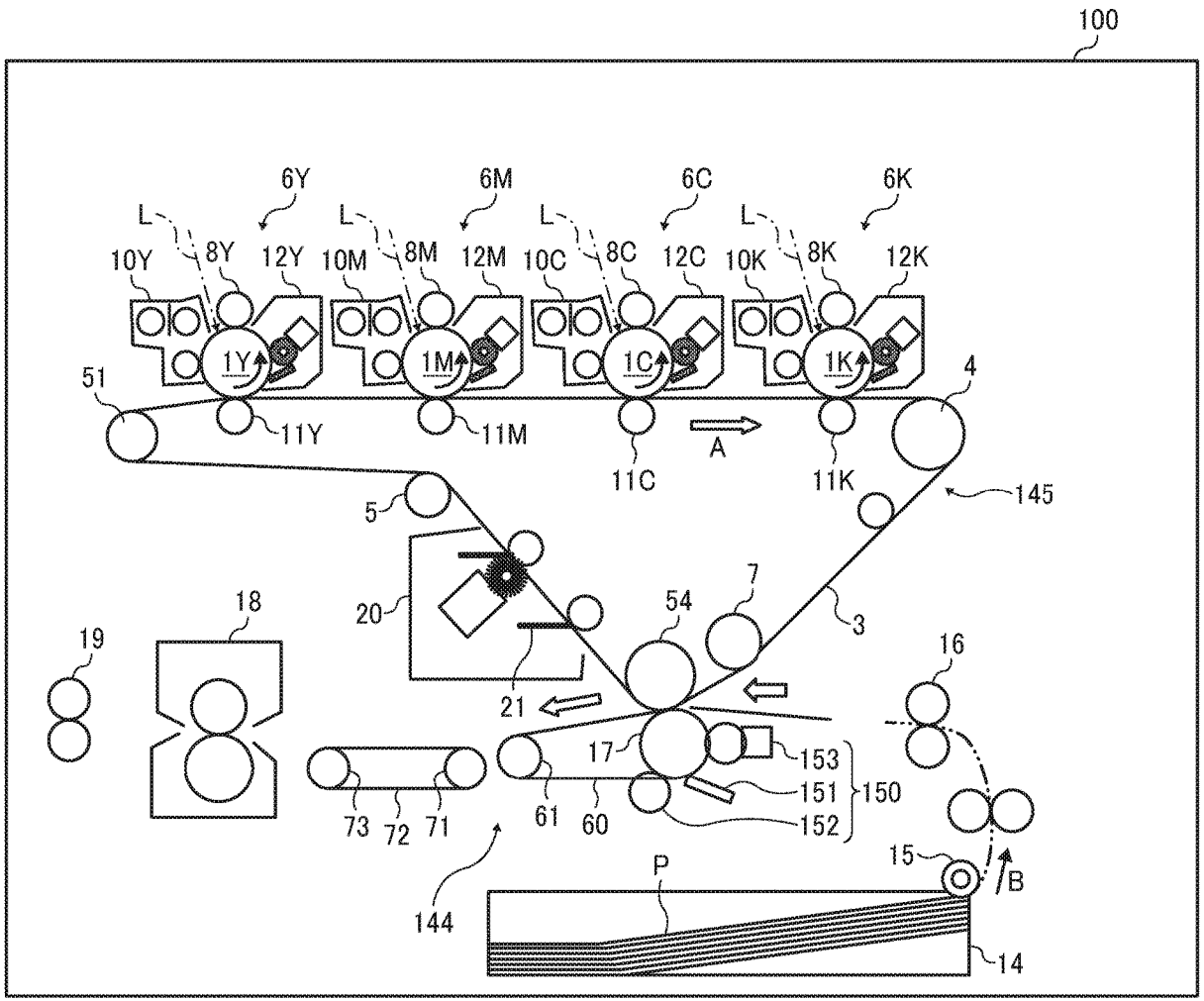
FIG. 1 is a schematic view of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. In addition, identical or similar reference numerals designate identical or similar components throughout the several views.

DETAILED DESCRIPTION

In describing embodiments illustrated in the drawings, specific terminology is employed for the sake of clarity. However, the disclosure of this patent specification is not intended to be limited to the specific terminology so selected, and it is to be understood that each specific element includes all technical equivalents that have the same function, operate in a similar manner, and achieve a similar result.

Referring now to the drawings, wherein like reference numerals designate identical or corresponding parts throughout the several views thereof, and particularly to FIG. 1, an image forming apparatus according to embodiments of the present disclosure is described. As used herein, the singular forms "a", "an", and "the" are intended to include the plural forms as well, unless the context clearly indicates otherwise.

It is to be noted that the suffixes Y, M, C, and K attached to each reference numeral indicate only that components indicated thereby are used for forming yellow, magenta, cyan, and black images, respectively, and hereinafter may be omitted when color discrimination is not necessary.

With reference to FIG. 1, a description is provided of an electrophotographic color printer (hereinafter referred to as printer 100) as an example of an image forming apparatus according to an illustrative embodiment of the present disclosure. A basic configuration of the printer 100 is described below.

FIG. 1 is a schematic view of the printer 100 according to the embodiment of the present disclosure. The printer 100 is a tandem-type color printer and includes image forming units 6Y, 6M, 6C, and 6K disposed inside a body of the printer 100. The image forming units 6Y, 6M, 6C, and 6K respectively include photoconductors 1Y, 1M, 1C, and 1K (hereinafter also collectively "photoconductors 1"). The photoconductors 1 serve as image bearers.

Toner images of different colors are formed on the photoconductors 1Y, 1M, 1C, and 1K respectively. More specifically, yellow toner image, magenta toner image, cyan toner image, and black toner image are formed on the photoconductors 1Y, 1M, 1C, and 1K from left to right, respectively. As illustrated in FIG. 1, the photoconductors 1 are drum-shaped. Alternatively, the image forming apparatus can employ, as photoconductors, endless belts entrained around a plurality of rollers and driven to rotate.

An intermediate transfer unit 145 as a belt device and a transfer device is disposed below the four photoconductors 1. The belt device serves as a belt driving mechanism in the image forming apparatus. The intermediate transfer unit includes an intermediate transfer belt 3.

The intermediate transfer belt 3 as an intermediate transferor is disposed facing and in contact with the four photoconductors 1. The intermediate transfer belt 3 is looped taut around a plurality of support rollers including a driving roller 4, a driven roller 51, a tension roller 5, a secondary-transfer backup roller 54, and an entry roller 7. As a drive source drives the driving roller 4, which is one of the support rollers, the intermediate transfer belt 3 rotates in the direction indicated by an arrow A in FIG. 1.

The intermediate transfer belt 3 may be a single-layer belt or a multi-layer belt. In the case of the multi-layer belt, the intermediate transfer belt 3 preferably includes a base layer formed of a material, such as fluoroplastic, polyvinylidene fluoride (PVDF) sheet, or polyimide resin, that is less stretchy, and a smooth coat layer formed of, for example, fluoroplastic covers a surface of the intermediate transfer belt 3. In the case of the single-layer belt, the belt is preferably made of, for example, polyvinylidene fluoride (PVDF), polycarbonate (PC), polyimide (PI), or the like.

Regardless of the color of toner, the configuration and operation to form toner images on the photoconductors 1 are similar. Similarly, the configuration and operation to transfer the toner images from the photoconductors 1 onto the intermediate transfer belt 3 are similar, differing only in the color of toner employed. Accordingly, a description is given of the configuration and operation to form yellow toner images on the photoconductor 1Y and transfer yellow toner images onto the intermediate transfer belt 3 as representative. Descriptions of the configuration and operation regarding other colors are omitted to avoid redundancy.

The photoconductor 1Y for yellow toner images rotates counterclockwise. As a static eliminating device irradiates a surface of the photoconductor 1Y with light, the surface potential of the photoconductor 1Y is initialized. A charging device 8Y uniformly charges the initialized surface of the photoconductor 1Y to a predetermined polarity (in the present embodiment, a negative polarity). Subsequently, an exposure device irradiates the charged surface of the photoconductor 1Y with a modulated laser beam L, thereby forming an electrostatic latent image corresponding to writing data on the surface of the photoconductor 1Y. According to the printer 100 in FIG. 1, the exposure device is a laser writing device that emits the laser beam L. Alternatively, the exposure device can include a light-emitting diode (LED) array and an imaging device.

The electrostatic latent image formed on the photoconductor 1Y is developed with yellow toner by a developing device 10Y into a visible image, known as a yellow toner image. A primary transfer roller 11Y for yellow toner images is disposed inside the looped intermediate transfer belt 3, opposite the photoconductor 1Y. The primary transfer roller 11Y contacts an inner face of the intermediate transfer belt 3 to form a primary transfer nip between the photoconductor 1Y and the intermediate transfer belt 3.

To the primary transfer roller 11Y, a primary transfer voltage opposite in polarity to the yellow toner image on the photoconductor 1Y is applied. In the present embodiment, the primary transfer voltage has a plus (positive) polarity. Thus, a primary-transfer electrical field is generated between the photoconductor 1Y and the intermediate transfer belt 3, and the toner image on the photoconductor 1Y is electrically transferred onto the intermediate transfer belt 3 that rotates in synchronization with the photoconductor 1Y. After the toner image is transferred onto the intermediate transfer belt 3, a cleaning device 12Y for yellow toner images removes residual toner remaining on the surface of the photoconductor 1Y.

Similarly, a magenta toner image, a cyan toner image, and a black toner image are respectively formed on the photoconductors 1M, 1C, and 1K, and the toner images of respective colors are sequentially superimposed one after another on the yellow toner image on the intermediate transfer belt 25.

The printer 100 has two drive modes: a full-color mode using at least two of four toners of different colors and a monochrome mode using only black toner. In the full-color mode, the intermediate transfer belt 3 contacts the four photoconductors 1Y, 1M, 1C, and 1K, and four color toner images are transferred onto the intermediate transfer belt 3 one on another. By contrast, in the monochrome mode, the intermediate transfer belt 3 contacts only the photoconductor 1K, and the black toner image is transferred onto the intermediate transfer belt 3. In the monochrome mode, the primary transfer rollers 11Y, 11M, and 11C are moved away from the photoconductors 1Y, 1M, and 1C by a contact-separation mechanism. Accordingly, the intermediate transfer belt is separated from the photoconductors 1Y, 1M, and 1C for the colors yellow, magenta, and cyan.

As illustrated in FIG. 1, a sheet feeder 14 is disposed in a bottom section of the body of the printer 100. A secondary transfer unit 144 as a belt device and a transfer device is disposed between the intermediate transfer unit 145 and the sheet feeder 14. The secondary transfer unit 144 includes a secondary transfer belt 60.

The secondary transfer belt 60 of the secondary transfer unit 144 is looped and stretched taut around a secondary transfer roller 17 and a separation roller 61. The secondary transfer roller 17 is disposed opposite the secondary-transfer backup roller 54 via the secondary transfer belt 60 and the intermediate transfer belt 3 to form a secondary transfer nip. The secondary transfer roller 17 is a driving roller that receives a driving force from a driver. As the secondary transfer roller 17 rotates, the secondary transfer belt 60 is endlessly moved, thereby rotating the separation roller 61 that is a driven roller. A recording medium P transported by the secondary transfer belt 60 separates from the secondary transfer belt 60 at the curved portion of the secondary transfer belt 60 wound around the separation roller 61, and is passed forward to a conveyance belt 72.

The sheet feeder 14 includes a sheet feeding roller 15 to pick up and send the recording medium P (i.e., recording sheet) in the direction indicated by an arrow B in FIG. 1. The recording medium P is fed by the registration roller pair 16 towards the secondary transfer nip with predetermined timing. At that time, the secondary-transfer backup roller 54 is supplied with a predetermined secondary transfer voltage to secondarily transfer the composite toner image from the intermediate transfer belt 3 onto the recording medium P transported through the secondary transfer nip.

The secondary transfer belt transports the recording medium P bearing the composite toner image transferred secondarily to a conveyance belt 72 disposed downstream from the secondary transfer belt 60, and then, the conveyance belt 72 transports the recording medium P to a fixing device 18 in a state in which the recording medium P is electrostatically attracted onto the conveyance belt 72. When the recording medium P passes through the fixing device 18, the fixing device 18 fixes the toner image on the recording medium P with heat and pressure. After the recording medium P passes through the fixing device 18, the recording medium P is discharged outside the body of the printer 100 through an output roller pair 19 of a discharge section. The conveyance belt 72 is looped around and stretched taut between a conveyance driving roller 71 and a conveyance driven roller 73. For example, the conveyance belt 72 is made of ethylene-propylene-diene rubber (EPDM) and 1 mm in thickness.

An intermediate transfer belt cleaning device 20 removes residual toner on the intermediate transfer belt 3 after the toner image is secondarily transferred to the recording medium P. In the printer 100, the intermediate transfer belt cleaning device 20 includes a cleaning blade 21 made of, for example, urethane. The posture of the cleaning blade 21 abutting against the intermediate transfer belt 3 is counter to the direction of rotation of the intermediate transfer belt 3. The intermediate transfer belt cleaning device 20 is not limited to the structure described above but can be selected from various cleaning types. For example, a cleaning device employing capacitance can be used.

A secondary transfer belt cleaning device 150 removes substances adhering to the secondary transfer belt 60. The adhering substances include toner not transferred to the recording medium P but adhering the secondary transfer belt 60, toner transferred from the intermediate transfer belt 3 to the secondary transfer belt 60 at an interval between the recording media P, and paper dust adhering the secondary transfer belt 60.

Specifically, the secondary transfer belt cleaning device 150 includes a dust-removal brush roller 152 and a secondary-transfer cleaning blade 151 made of, for example, urethane.

The dust-removal brush roller 152 rotates in the direction counter to the rotation of the secondary transfer belt 60 to remove foreign substances. The secondary-transfer cleaning blade 151 is disposed downstream of the dust-removal brush roller 152. The secondary-transfer cleaning blade 151 contacts the secondary transfer belt 60 in the direction counter to the direction of travel of the secondary transfer belt 60 (hereinafter referred to as belt travel direction). Additionally, a lubricant applicator 153 to apply a lubricant to the secondary transfer belt 60 is disposed downstream of the secondary-transfer cleaning blade 151. The lubricant applicator 153 includes a lubricant application brush roller 153*a* and a solid lubricant 153*b*. The lubricant applied to the secondary transfer belt 60 suppresses foreign substances adhesion (filming).

Next, the belt deviation correction of the secondary transfer unit 144 is described below, with continued reference to FIG. 1.

In the image forming apparatus, various endless belts are used as a latent image bearer, an intermediate transferor, a conveyor of the recording medium, a fixing member, and the like. This kind of endless belt is looped and stretched taut around at least two rollers to travel in a constant direction. The endless belt is drawn to one side in the axial direction perpendicular to the belt travel direction (i.e., belt deviation) due to materials of the endless belt, accuracies of relevant components, or age degradations of relevant components. The belt deviation causes a deviation or misalignment of a transferred image on the recording medium or damage to the belt by coming off the roller. Therefore, the belt deviation is corrected in the present embodiment.

In the present embodiment, the secondary transfer unit 144 includes a rotator inclination unit to correct the belt deviation. The rotator inclination unit inclines the separation roller 61 relative to the secondary transfer roller 17 corresponding to the amount of displacement of the secondary transfer belt 60, which is drawn to one side, in the axial direction. When the endless belt is drawn to one side in the axial direction, a force to draw the secondary transfer belt 60 in the belt deviation direction balances a force to move the secondary transfer belt 60 in reverse direction of the belt deviation to keep the secondary transfer belt 60 stationary in the axial direction.

There are belt deviation suppression mechanisms without the rotator inclination unit, which include a flange serving as a restriction member to restrict the belt not to move further in the axial direction. The flange is disposed near an end of the roller in the axial direction, and an end face of the belt that is drawn to the axial end contacts the flange to stop axial movement. With this configuration without the rotator inclination unit, the end face of the belt that is drawn to the axial end is pressed against the flange, and stress is applied to a contact portion between the belt and the flange. Accordingly, a side end of the belt may be bent.

Furthermore, as another type of belt deviation restriction mechanisms without the rotator inclination unit, rib-type belt deviation restriction mechanisms includes guide ribs disposed at both ends in width direction on an inner surface of a belt. In the rib-type belt deviation restriction mechanism, when the belt is drawn to one side in the axial direction, the guide rib contacts a restriction end face of a support roller (generally, end face of the roller) to restrict further movement in the width direction. The rib-type belt deviation restriction mechanism restricts the belt deviation within a range between a first position on one end side and a second position on the other end side in the width direction. One guide rib disposed on the one end side in the width direction contacts one restriction end face of the support roller at the first position. The other guide rib disposed on the other end side in the width direction contacts the other restriction end face of the support roller at the second position.

In the rib-type belt deviation restriction mechanism, the guide rib disposed on the belt contacts the side end face of the support roller or engages with an engaged portion of the support roller to suppress belt walk. Accordingly, as the engaged portion or contact portion of the support roller slidingly contact the guide ribs, the belt may be broken by stress repeatedly acting due to the belt walk.

By contrast, according to the secondary transfer unit 144 in the present embodiment, the separation roller 61 is inclined, and a force to move the secondary transfer belt 60 in the reverse direction of the belt deviation acts on the secondary transfer belt 60, thereby reducing the load on the end faces of the secondary transfer belt 60 and controlling the belt deviation. With this configuration, the secondary transfer belt 60 does not keep the sliding contact in a certain portion, and the stress does not keep acting on the secondary transfer belt 60 in a certain portion. Therefore, the breakage of the secondary transfer belt 60 is avoided.

An outer diameter of the separation roller 61 is approximately 15 mm. A material thereof includes aluminum. A material of the secondary transfer belt 60 includes polyimide. Young's modulus of the secondary transfer belt 60 is approximately 3000 MPa. Folding endurance of the secondary transfer belt 60 measured by the Massachusetts Institute of Technology (MIT) folding endurance tester is approximately 6000 times. A thickness of the secondary transfer belt 60 is approximately 80 μm. A linear velocity of the secondary transfer belt 60 is approximately 352 mm/s. Belt tension is approximately 0.9 N/cm.

A measuring method of the MIT folding endurance test conforms to Japanese Industrial Standard (JIS)-P8115. More specifically, a sample belt having a width of 15 mm was measured under conditions of a testing load of 1 kgf, a flexion angle of 135 degrees, and a flexion speed of 175 times per minute.

Next, the rotator inclination unit to incline the separation roller 61 is described in further detail below.

Figure 2A:
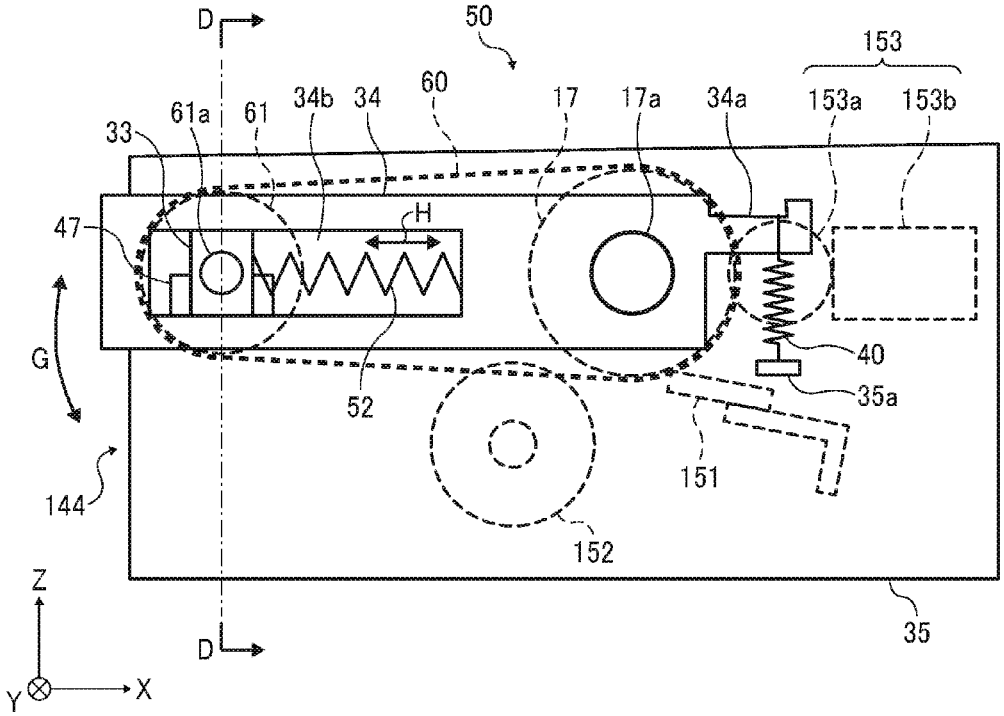
FIG. 2A is a schematic front view of a belt alignment unit in an initial state, according to an embodiment.
Figure 2B:
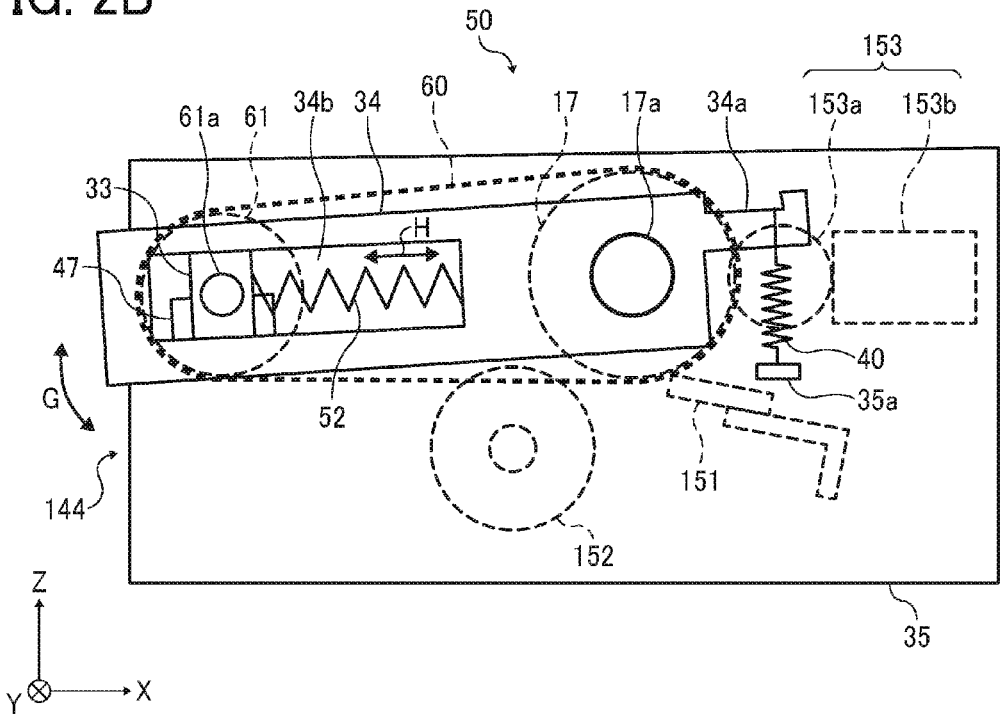
FIG. 2B is a schematic front view of the belt alignment unit in a state of belt deviation correction, according to an embodiment.

FIGS. 2A and 2B are schematic views of a belt alignment unit 50 serving as the rotator inclination unit as viewed from the front side in FIG. 1 in the axial direction. The rotator inclination unit inclines the separation roller 61 to adjust the position of the secondary transfer belt 60 in the axial direction. FIG. 2A is the schematic view of the belt alignment unit 50 in an initial state, in which the separation roller 61 is not inclined, right after assembly. FIG. 2B is the schematic view of the belt alignment unit 50 in a state of belt deviation adjustment.

Figure 3:
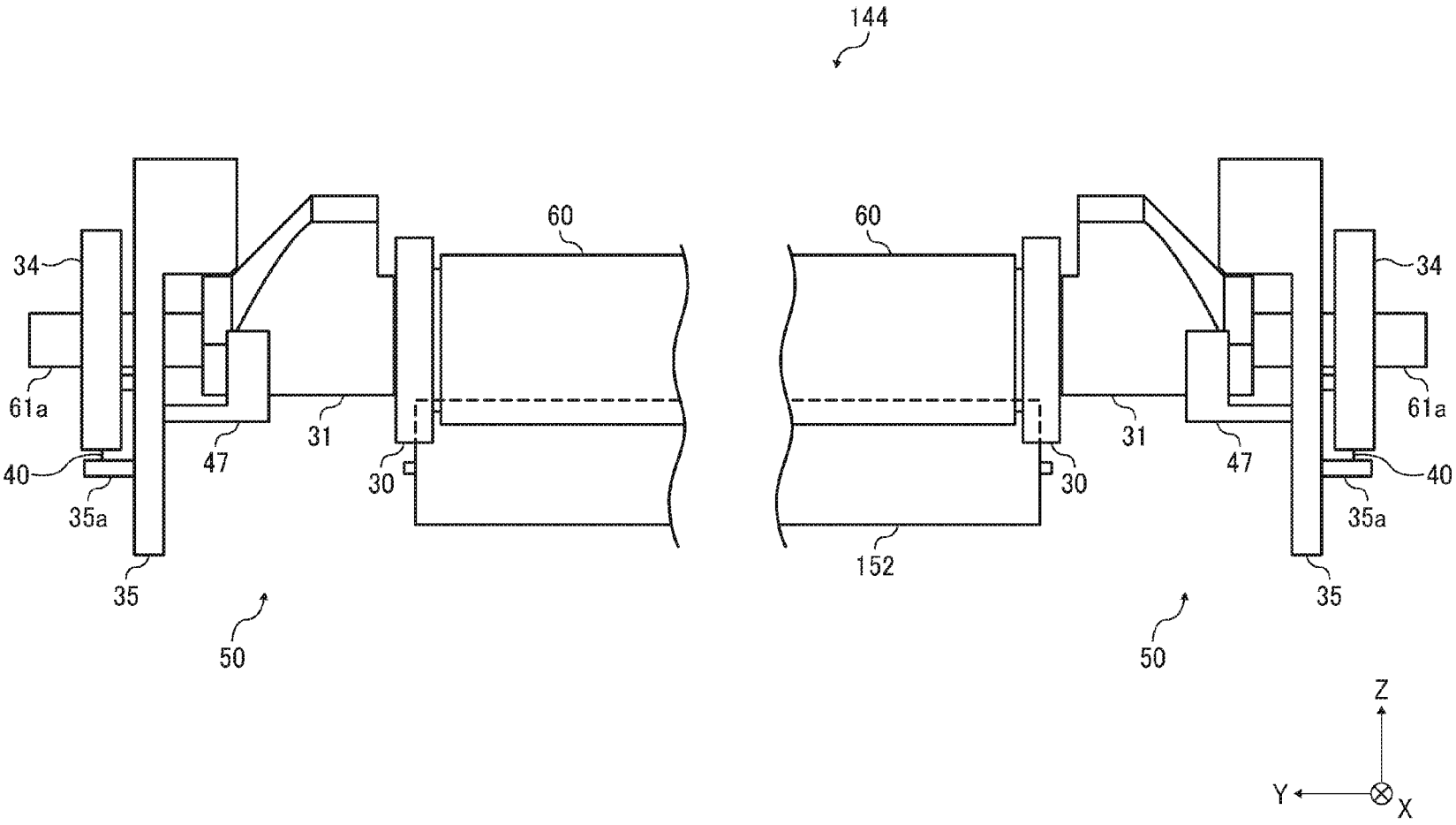
FIG. 3 is a schematic side view of a secondary transfer unit according to an embodiment.
Figure 4:
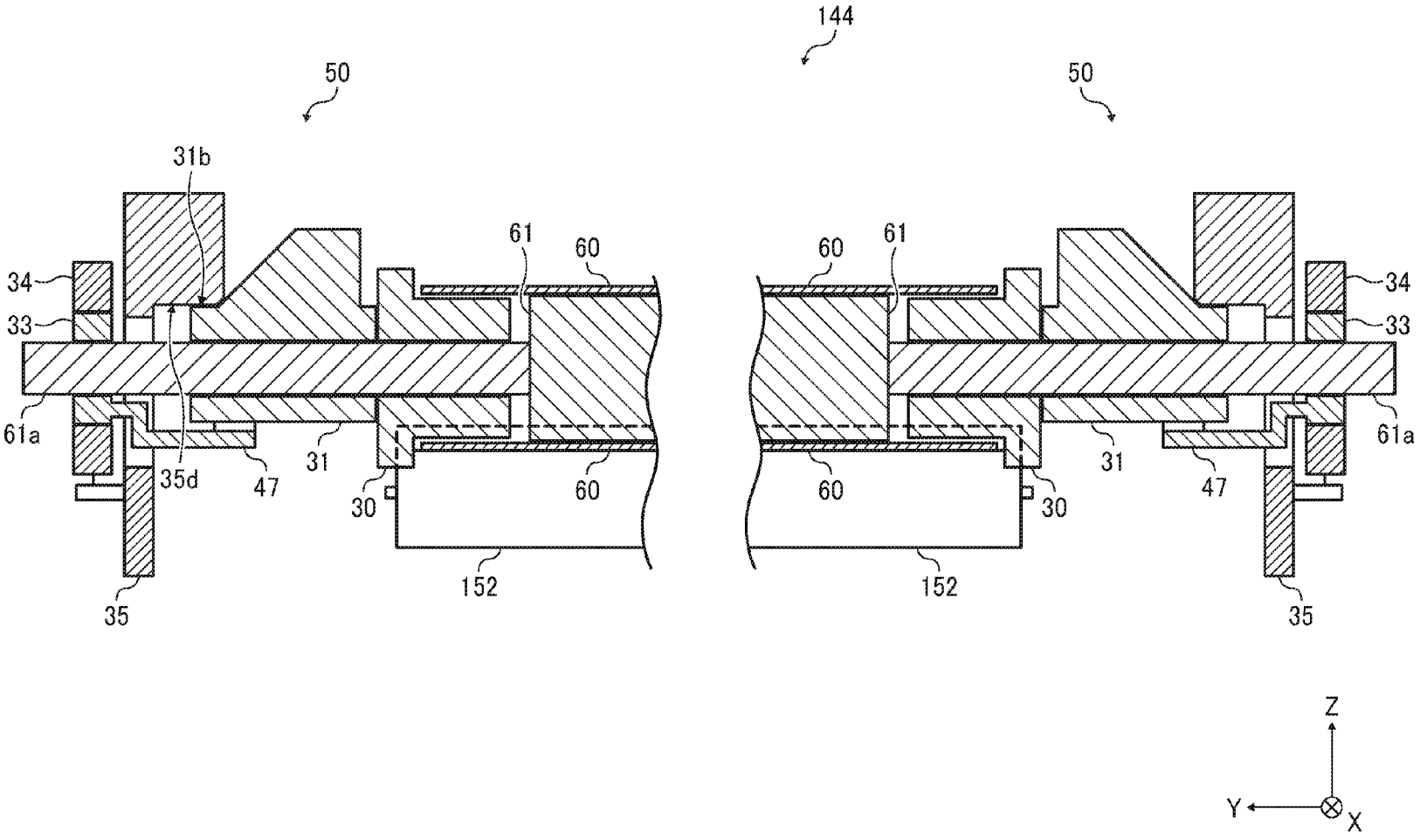
FIG. 4 is a schematic cross-sectional view of the secondary transfer unit according to an embodiment according to an embodiment.

FIG. 3 is a schematic side view of the secondary transfer unit 144 as viewed from the left side in FIGS. 2A and 2B. FIG. 4 is a schematic cross-sectional view of the secondary transfer unit 144 along line D-D illustrated in FIGS. 2A and 2B.

Figure 5:
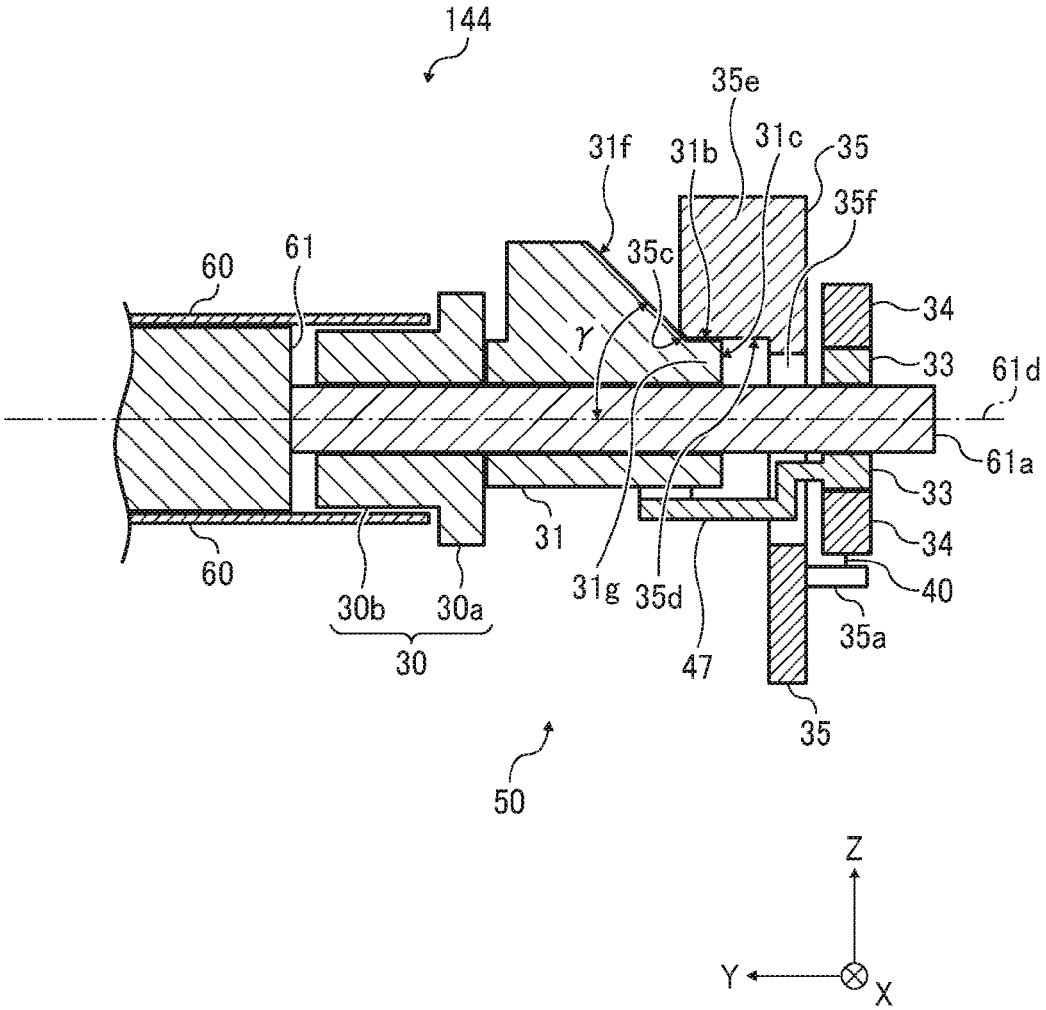
FIG. 5 is a schematic enlarged cross-sectional view of the belt alignment unit in the initial state, according to an embodiment.
Figure 6:
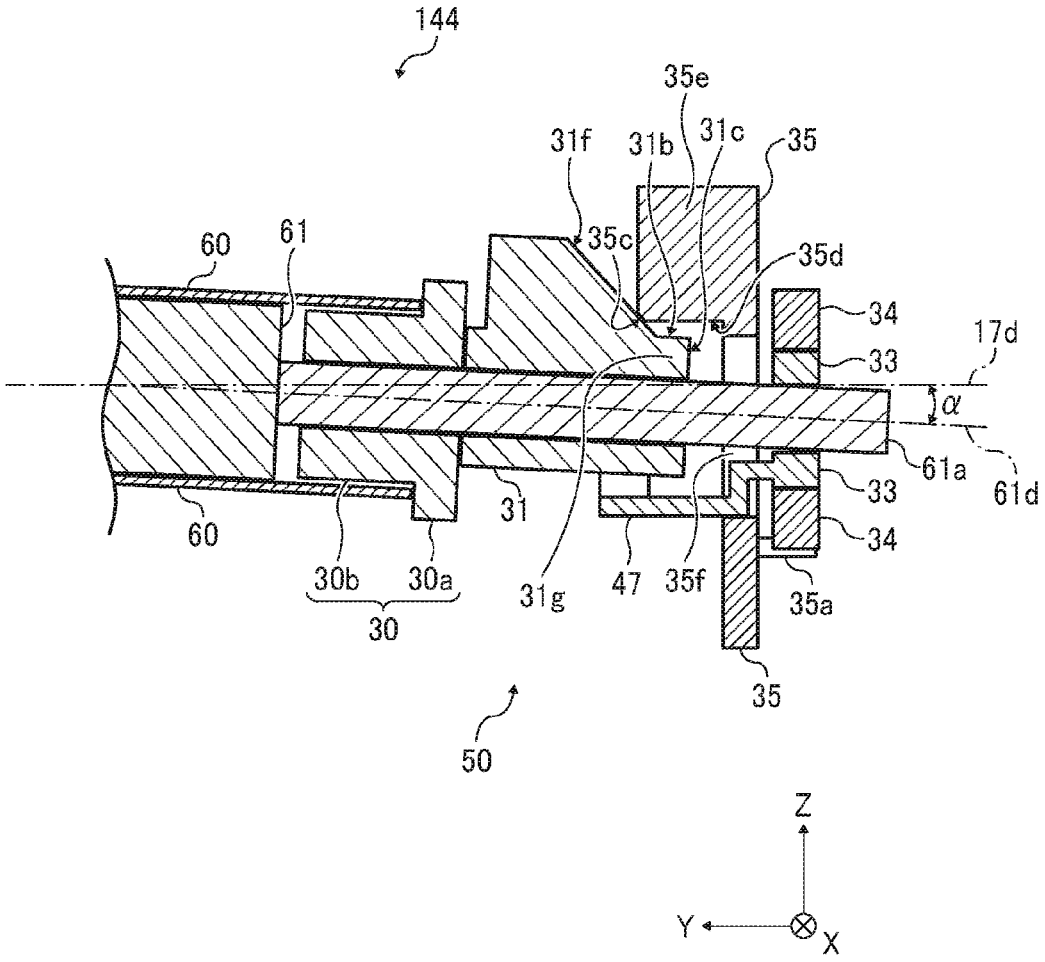
FIG. 6 is a schematic enlarged cross-sectional view of the belt alignment unit in the state of belt deviation correction, according to an embodiment.

FIG. 5 is a schematic enlarged cross-sectional view on the front side of the belt alignment unit 50 (right side in FIG. 3 and FIG. 4). FIG. 6 is a schematic enlarged cross-sectional view on the front side of the belt alignment unit 50 when the front side of a separation roller shaft 61*a* is displaced downward and the separation roller 61 is inclined.

The dust-removal brush roller 152 elastically deforms along the secondary transfer belt 60. In FIGS. 2A, 2B, 3, and 4, an upper end of the dust-removal brush roller 152 is located above the secondary transfer belt 60. The location indicates that the dust-removal brush roller 152 is pressed against the secondary transfer belt 60 with certain pushing amount. In FIGS. 3 and 4, broken lines indicate a perimeter of a virtual area of the dust-removal brush roller 152 when the dust-removal brush roller 152 does not elastically deform.

As illustrated in FIG. 4, the separation roller 61 coaxially includes the separation roller shaft 61*a* at an end portion of the separation roller 61. The separation roller shaft 61*a* has a cylinder shape smaller in diameter than the separation roller 61 and is joined with the separation roller 61. The belt alignment unit 50 includes a belt deviation follower 30, a shaft inclining member 31, a frame 35, and a roller shaft support 34, which are disposed on the separation roller shaft 61*a* and arranged in that order from a center side in the axial direction of the separation roller 61. The separation roller shaft 61*a* penetrates these components: the belt deviation follower 30, the shaft inclining member 31, the frame 35, and the roller shaft support 34. The both end portions of the separation roller shaft 61*a* are supported by the roller shaft supports 34 via the separation roller bearings 33.

In the belt alignment unit 50, the belt deviation follower 30 and the shaft inclining member 31 are freely movable in the axial direction relative to the separation roller shaft 61*a*. In the direction perpendicular to the axis of the separation roller shaft 61*a*, the belt deviation follower 30 and the shaft inclining member 31 move with the separation roller shaft 61*a*.

The secondary transfer unit 144 also includes the frame 35 made of a metal plate. The frame 35 is secured to the body of the printer 100 and is stationary when the separation roller shaft 61*a*, the belt deviation follower 30, and the shaft inclining member 31 move. The frame 35 includes a spring secured portion 35*a* that protrudes outward from the outer surface of the frame 35 in the axial direction (front-back direction of the body). In addition, the frame 35 has a frame opening 35*f* that is penetrated by the separation roller shaft 61*a* and a rotation stopper 47. The separation roller shaft 61*a* and the rotation stopper 47 are displaced in the direction perpendicular to the axis of the separation roller 61 by a pressing force of a tension spring 52 and a force thereagainst and a pressing force of a support spring 40 and a force thereagainst as illustrated in FIG. 2. The frame opening 35*f* is shaped so that the separation roller shaft 61*a* and the rotation stopper 47 do not interfere with the frame 35 regardless the displacement thereof.

The roller shaft support 34 is pivotably attached to a rotation shaft 17*a* of the secondary transfer roller 17. The roller shaft support 34 is pivotable in the direction indicated by an arrow G in FIGS. 2A and 2B relative to the frame 35. As the roller shaft support 34 pivots, the separation roller 61 is vertically displaced.

One end of the support spring 40 is secured to the spring secured portion 35*a* of the frame 35. The support spring 40 pulls the roller shaft support 34. The other end of the support spring 40 is secured to a spring secured portion 34*a* of the roller shaft supports 34.

The support spring 40 pulls the roller shaft supports 34 disposed at both ends of the separation roller shaft so that the roller shaft supports 34 pivot clockwise around the rotation shaft 17*a* of the secondary transfer roller 17 in FIG. 2.

As the roller shaft support 34 pivots around the rotation shaft 17*a* of the secondary transfer roller 17, the end of the separation roller shaft 61*a* supported by the roller shaft support 34 is displaced in the vertical direction via the separation roller bearing 33 As illustrated in FIGS. 5 and 6, the roller shaft support 34 does not pivot clockwise from a state illustrated in FIG. 2A because of a contact between a stopped face 31*b* and a stopper face 35*d*. With this configuration, the separation roller shaft 61*a* and separation roller 61 is displaced only downward in the state illustrated in FIG. 2A Two roller shaft supports 34 include a bearing slide slot 34*b* and support the separation roller bearing 33. The separation roller bearing 33 is slidable in a radial direction indicated by an arrow H in FIG. 2 from a rotation center of the roller shaft support 34. The separation roller bearing 33 is biased outward by the tension spring 52 in the radial direction from the rotation center of the roller shaft support 34 (leftward in FIG. 2). With this configuration, the separation roller 61 is always biased in such a direction that the separation roller 61 separates from the secondary transfer roller 17. Accordingly, a certain tension is applied to the secondary transfer belt 60 looped around the separation roller 61 and the secondary transfer roller 17.

As illustrated in FIG. 5, the belt deviation follower 30 and the shaft inclining member 31 are disposed on the separation roller shaft 61*a* between the separation roller 61 and the separation roller bearing 33. The belt deviation follower 30 and the shaft inclining member 31 constitute a rotator inclination unit. The belt deviation follower 30 is disposed outboard of the separation roller 61 in the axial direction of the separation roller 61, and the shaft inclining member 31 is disposed outboard of the belt deviation follower 30 in the axial direction of the separation roller 61. The belt deviation follower 30 includes a flange 30*a* and a cylindrical portion 30*b*. The cylindrical portion 30*b* has a smaller diameter than the separation roller 61. The flange 30*a* has a larger diameter than the separation roller 61. As the secondary transfer belt 60 is drawn to one side in the width direction (belt deviation), the end portion of the secondary transfer belt 60 contacts the inside surface of the flange 30*a* in the axial direction.

Next, a description is provided of the operation of the belt alignment unit 50 of the secondary transfer unit 144 according to the present embodiment.

When the secondary transfer roller 17, which is a driving roller, starts rotating, the separation roller 61, which is a driven roller, starts rotating. Around the secondary transfer roller 17 and the separation roller 61, the secondary transfer belt 60 is looped. At that time, in the case in which the end of the secondary transfer belt 60 is in contact with the belt deviation follower 30, the belt deviation follower 30 also starts rotating.

In this state, if the secondary transfer belt 60 is drawn to the right in FIG. 5 in the belt width direction (the axial direction of the separation roller 61) due to effects of parallelism between the components, the right end (in FIG. 5) of the secondary transfer belt 60 in the belt width direction contacts the flange 30*a* of the belt deviation follower 30. In this specification, the term "belt deviation" means that the belt is drawn to one side in the belt width direction. Receiving the force of contact, the belt deviation follower 30 moves outward along the separation roller shaft 61*a* (right in FIG. 5) in the axial direction thereof. As the belt deviation follower 30 moves toward the end of the separation roller shaft 61*a*, the shaft inclining member 31 is pushed by the belt deviation follower 30 to the end side in the axial direction. The shaft inclining member 31 is closer to the end of the separation roller shaft 61*a* than the belt deviation follower 30. Then, the shaft inclining member 31 also moves along the separation roller shaft 61*a* to the end side in the axial direction.

An upper side of the shaft inclining member 31 in FIG. 5 includes an inclined face 31*f* inclined relative to the separation roller shaft 61*a*. The frame 35 includes a guide portion 35*e* protruding inward in the axial direction. Against the inclined face 31*f*, an inclined face contact portion 35*c* of the guide portion 35*e* contacts from the end side (right side in FIG. 5) in the axial direction. An end portion of the separation roller shaft 61*a* closer to the end (on right in FIG. 5) in the axial direction than the shaft inclining member 31 is supported by the roller shaft support 34 via the separation roller bearing 33, as described above. Since the support spring 40 biases the roller shaft support 34 to pivot clockwise in FIGS. 2A and 2B around the rotation shaft 17*a* of the secondary transfer roller 17, the end of the separation roller shaft 61*a* is biased upward in FIG. 5.

The shaft inclining member 31 includes a restriction portion 31*g* with the stopped face 31*b* as a top face and an axial outer end face 31*c* as a side face. A lower end of the inclined face 31*f* of the shaft inclining member 31 is continuous with the stopped face 31*b* extending in the axial direction of the separation roller shaft 61*a*. In a state in which the end of the secondary transfer belt 60 in the belt width direction is contactless with the flange 30*a*, the stopped face 31*b* of the shaft inclining member 31 is urged upward by the support spring 40 and contacts a lower face of the stopper face 35*d*. Accordingly, at the position at which the stopped face 31*b* of the shaft inclining member 31 contacts the stopper face 35*d* of the frame 35, the position at which the inclined face 31*f* of the shaft inclining member 31 abuts against the inclined face contact portion 35*c* of the frame 35 is determined. Accordingly, in the state in which the inclined face contact portion 35*c* of the frame 35 abuts against the lower end of the inclined face 31*f* of the shaft inclining member 31, the relative positions thereof are maintained.

From this state, when the secondary transfer belt 60 is urged to move to the right in FIGS. 4 and 5 in the belt width direction, as described above, the end of the secondary transfer belt 60 in the belt width direction contacts the flange 30*a* of the belt deviation follower 30 (end of front side of the printer 100) in the axial direction. When the secondary transfer belt 60 moves further to the right in FIG. 5 in the belt width direction, the belt deviation follower 30 and the shaft inclining member 31 move along the separation roller shaft 61*a* to the end side (right side in FIG. 5) in the axial direction. At that time, the inclined face contact portion 35*c* of the frame 35 relatively moves along the inclined face 31*f* of the shaft inclining member 31. The contact position at which the inclined face 31*f* of the shaft inclining member 31 contacts the inclined face contact portion 35*c* of the frame 35 moves up towards the upper portion of the inclined face 31*f* of the shaft inclining member 31.

As a result, the end portion of the separation roller shaft 61*a* on the side to which the secondary transfer belt 60 is drawn (i.e., "belt drawing side") is pushed down against the upward biasing force exerted by the support spring 40.

At that time, on the side (left side in FIG. 4) opposite the belt drawing side, the end portion of the secondary transfer belt 60 is not in contact with the flange 30*a* of the belt deviation follower 30 on the left side in FIG. 4. Therefore, similar to FIG. 5, in the end portion of the separation roller shaft 61*a* on the side opposite the belt drawing side, the inclined face contact portion 35*c* of the frame 35 is kept in contact with the lower end of the inclined face 31*f* of the shaft inclining member 31.

Therefore, the end portion of the separation roller shaft 61*a* on the belt drawing side (right side in FIG. 4) is pressed lower relative to the other end, thereby inclining the separation roller shaft 61*a* as illustrated in FIG. 6. In the secondary transfer unit 144 of the present embodiment, the separation roller shaft 61*a* inclines so that the right end of the separation roller shaft 61*a* in FIG. 4 moves downwards with a contact point between the stopped face 31*b* and the stopper face 35*d* on the left end side in FIG. 4 as a fulcrum.

As the separation roller shaft 61*a* thus inclines, the speed at which the secondary transfer belt 60 deviates in the belt width direction gradually slows down, and, eventually, the secondary transfer belt 60 moves in the direction opposite to the belt drawing direction. As a result, the deviated secondary transfer belt 60 gradually returns to the original position in the belt width direction. Thus, the secondary transfer belt 60 can reliably travel with the belt deviation in the belt width direction settled. The same is true for the case where the secondary transfer belt 60 is drawn to the opposite side to the case described above.

As the drawing force no longer act on the secondary transfer belt 60, the roller shaft support 34 that supports the separation roller shaft 61*a* pushed down by the belt deviation pivots clockwise by tension of the support spring 40 in FIG. 2.

A description is provided of a principle of correction of deviation of the secondary transfer belt 60 by inclining the separation roller shaft 61*a*.

Figure 7A:
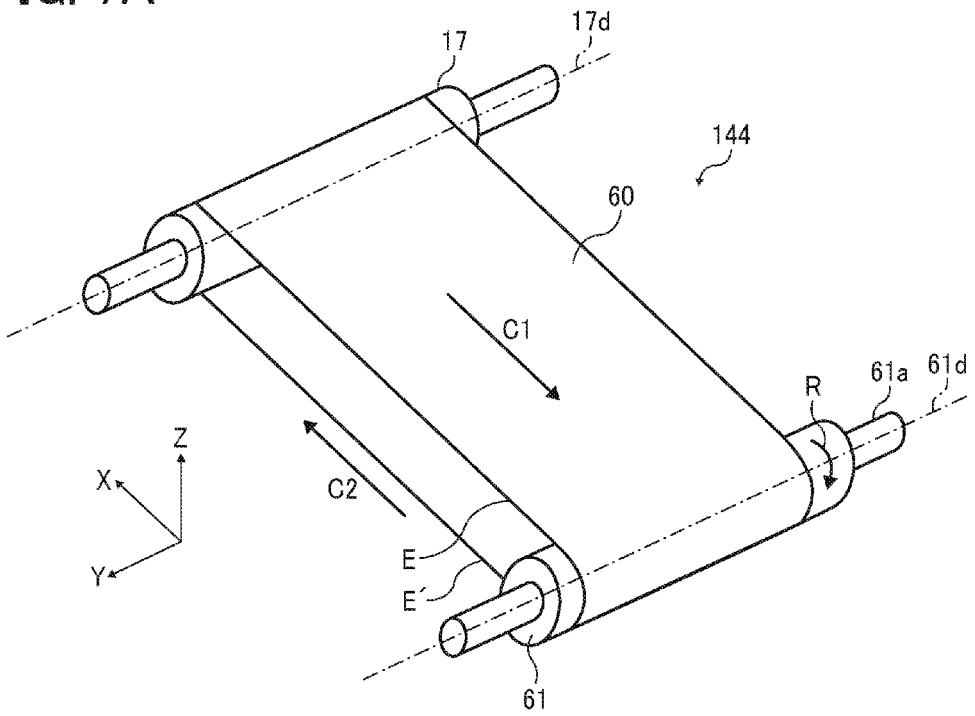
FIG. 7A is a schematic perspective view of the secondary transfer unit in a state of parallel rotation axes of two rollers, according to an embodiment.
Figure 7B:
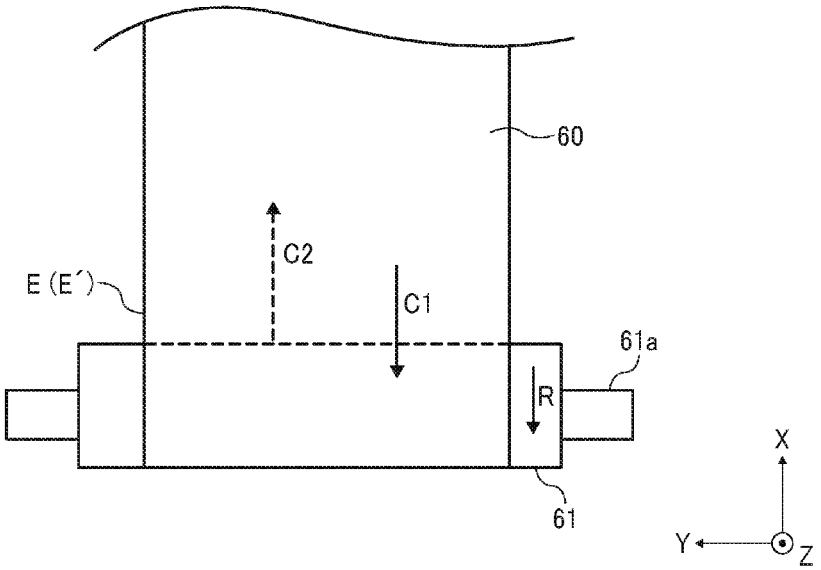
FIG. 7B is a schematic top view of the secondary transfer unit in a state of the parallel rotation axes of the two rollers, according to an embodiment.

FIGS. 7A and 7B are schematic views of the secondary transfer unit 144 in a state in which the rotation axis 61*d* of the separation roller 61 and the rotation axis of the secondary transfer roller 17 are parallel. FIG. 7A is a schematic perspective view of the separation roller 61, the secondary transfer roller 17, and the secondary transfer belt 60. FIG. 7B is a schematic partial top view of the secondary transfer unit 144 near the separation roller 61.

Figure 8A:
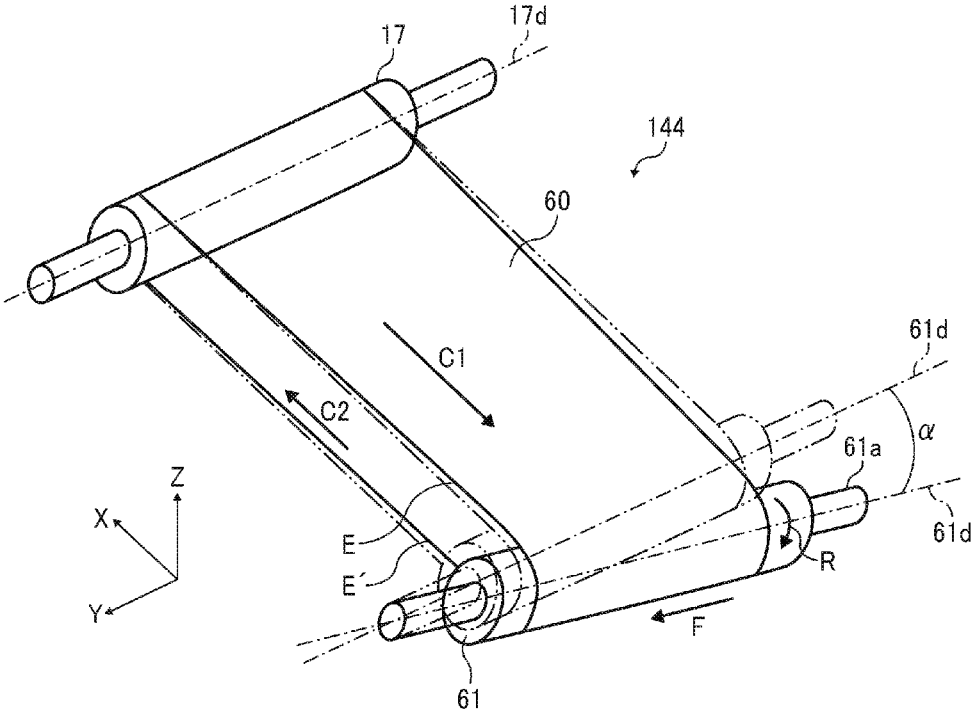
FIG. 8A is a schematic perspective view of the secondary transfer unit in a state of inclined rotation axes of the two rollers, according to an embodiment.
Figure 8B:
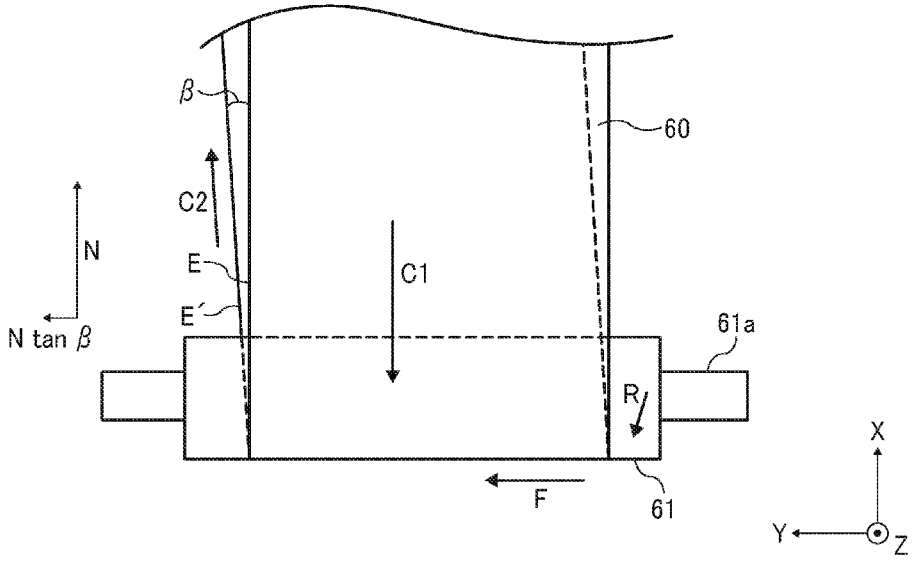
FIG. 8B is a schematic top view of the secondary transfer unit in the state of the inclined rotation axes of the two rollers, according to an embodiment.

FIGS. 8A and 8B are schematic views of the secondary transfer unit in a state in which the rotation axis 61*d* of the separation roller 61 are inclined relative to the rotation axis 17*d* of the secondary transfer roller 17 by angle α. The state in FIGS. 8A and 8B is that right end of the separation roller shaft 61*a* in FIG. 7 moves downward from the state in FIG. 7. FIG. 8A is a schematic perspective view of the separation roller 61, the secondary transfer roller 17, and the secondary transfer belt 60. FIG. 8B is a schematic partial top view of the secondary transfer unit 144 near the separation roller 61. In FIG. 8A, a chain double-dashed line is a phantom line that represents the position of the separation roller 61 and the secondary transfer belt 60 before inclining the rotation axis 61*d* of the separation roller 61.

As illustrated in FIG. 4, the width of the secondary transfer belt 60 according to the present embodiment is wider than a length of the separation roller 61 in the axis direction. In FIGS. 7A, 7B, 8A, and 8B, however, the separation roller 61 is illustrated long in the axis direction for convenience of explanation.

An arrow C1 in FIGS. 7A, 7B, 8A, and 8B represents the belt travel direction of the secondary transfer belt 60 before contacting the separation roller 61. An arrow C2 in FIGS. 7A, 7B, 8A, and 8B represents the belt travel direction of the secondary transfer belt 60 looped around the separation roller 61 after leaving the separation roller 61. An arrow R in FIGS. 7A, 7B, 8A, and 8B represents a movement direction of a surface of the separation roller 61 in the portion where the secondary transfer belt 60 is looped around. The surface of the separation roller 61 at the portion around which the secondary transfer belt 60 is looped moves from top to bottom.

As the secondary transfer belt 60 rotates, the separation roller 61 is rotated by friction between the inner surface of the secondary transfer belt 60 and the outer surface of the separation roller 61. At that time, a force along a movement direction of a circumferential face of the separation roller 61 act on the separation roller 61 at the portion around which the secondary transfer belt 60 is looped.

It is assumed that the secondary transfer belt 60 is a rigid body, and an arbitrary point on the secondary transfer belt 60 upstream in the belt travel direction from the contact region winding around the separation roller 61 is observed. Here, an arbitrary point on the belt end portion of the secondary transfer belt 60 immediately before advancing to the separation roller 61 is referred to as a point E on the belt end portion, and a point corresponding to the point E immediately after leaving the separation roller 61 is referred to as a point E'.

In a state in which two rotation axes of the secondary transfer roller 17 and the separation roller 61 are parallel, the belt travel direction (arrow C1) and the movement direction (arrow R) of the circumferential face of the separation roller 61 are parallel when viewed from the top as illustrated in FIG. 7B. Thus, a force along the separation roller shaft 61*a* does not act on the portion of the secondary transfer belt 60 wound around the separation roller 61. The secondary transfer belt moves parallel to the arrows C1 when viewed from the top. At that time, the point E does not move in the axial direction of the separation roller 61 and rotates on the circumferential face as the separation roller 61 rotates.

Then, the belt travel direction (arrow C2) after leaving the separation roller 61 is parallel and opposite the belt travel direction (arrow C1) before advancing to the separation roller 61 as viewed from the top. Accordingly, as the secondary transfer belt 60 near the separation roller 61 is observed from the top, the secondary transfer belt 60 after leaving the separation roller 61 is hidden under the secondary transfer belt 60 before advancing the separation roller 61. The deviation of the position in the axial direction between the point E and the point E' does not occur. In this case, the secondary transfer belt 60 is not drawn to one side in the axial direction.

As described above, the rotation axis 61*d* of the separation roller 61 is inclined at the inclination angle α relative to the rotation axis 17*d* of the secondary transfer roller 17 in FIGS. 8A and 8B. In a state in FIGS. 8A and 8B, the belt travel direction (arrow C1) before advancing to the separation roller 61 is inclined relative to the movement direction (arrow R) of the circumferential face of the separation roller 61 from the top as illustrated in FIG. 8B. Thus, a force along the separation roller shaft 61*a* indicated by an arrow F in FIGS. 8A and 8B act on the secondary transfer belt 60 as the secondary transfer belt 60 is obliquely wound around the separation roller 61. Here, a slope of the belt travel direction (arrow C2) after leaving the separation roller 61 relative to the belt travel direction (arrow C1) before advancing to the separation roller 61 is an angle β. In this case, the point E moves to the left by a distance N tan β in the axial direction of the separation roller 61 in FIG. 8B while moving on the circumferential face of the separation roller 61 by a distance N When seen from the top, the larger the slope of the movement direction (arrow R) of the circumferential face of the separation roller 61 relative to the belt travel direction (arrow C1) before advancing to the separation roller 61 is, the larger the angle β is. Additionally, the larger the inclination angle α of the rotation axis 61*d* of the separation roller 61 relative to the rotation axis 17*d* of the secondary transfer roller 17 is, the larger the angle β is. Accordingly, in the case of the secondary transfer belt 60 moving at constant liner velocity, the larger the inclination angle α is, the larger the amount of the belt deviation of the secondary transfer belt 60 (moving speed in the width direction of the belt) is.

That is, the amount of the belt deviation of the secondary transfer belt 60 is proportional to the inclination angle α. The amount of the belt deviation increases as the inclination angle α increases, and the amount of the belt deviation decreases as the inclination angle α decreases.

As illustrated in FIG. 6, as the secondary transfer belt 60 is drawn to the right in FIG. 6, the shaft inclining member 31 moves to the right in the axial direction due to the belt deviation. Accordingly, the right end of the separation roller shaft 61*a* in FIG. 6 moves downward, and the belt drawing to return to the left occurs.

Then, the belt deviation can be corrected and the secondary transfer belt 60 is adjusted at the position where the initial deviation (i.e., to the right in FIG. 3) of the secondary transfer belt 60 is balanced with the opposite deviation caused by inclining the separation roller shaft 61*a* of the separation roller 61. Even when the secondary transfer belt 60 traveling at the balanced position starts to deviate to either side, the separation roller shaft 61*a* is then inclined in accordance with the deviation of the secondary transfer belt 60, thereby again bringing the secondary transfer belt 60 to another balanced position.

As described above, according to the present embodiment, the belt alignment unit 50 of the secondary transfer unit 144 inclines the separation roller shaft 61*a* by an inclination angle corresponding to the amount of deviation of the secondary transfer belt 60 in the belt width direction, thereby promptly correcting the deviation of the secondary transfer belt 60. Further, the force of the secondary transfer belt 60 moving in the belt width direction is used to incline the separation roller shaft 61*a*. Accordingly, belt deviation can be corrected with a simple structure, and use of an additional drive source such as a motor is obviated.

As described above, as the right end of the separation roller shaft 61*a* in FIG. 4 moves downward, the drawing force acts on the secondary transfer belt 60 to return to the left. Similarly, as the left end of the separation roller shaft 61*a* moves downward, the drawing force acts on the secondary transfer belt 60 to move to the right.

Next, a description is provided of the shaft inclining member 31.

Figure 9A:
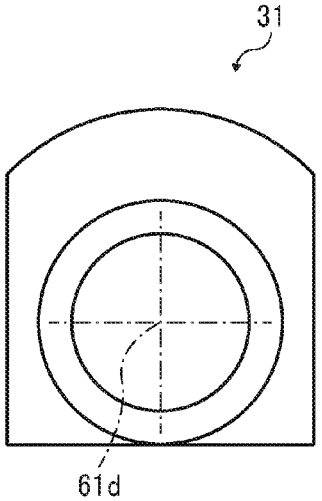
FIGS. 9A, 9B, 9C, and 9D are schematic views of a shaft inclining member, according to an embodiment.
Figure 9B:
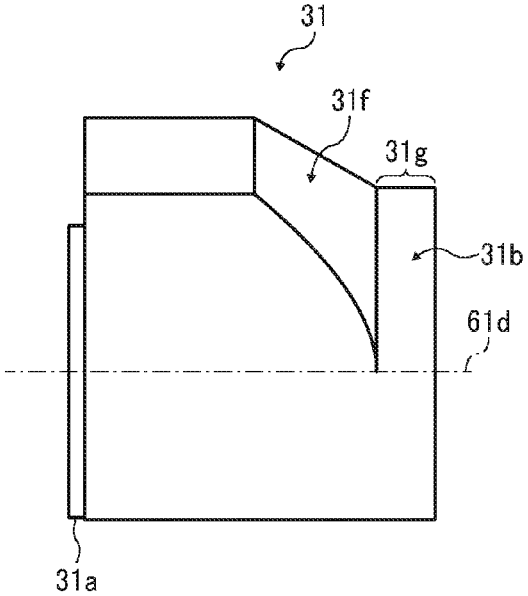
Figure 9C:
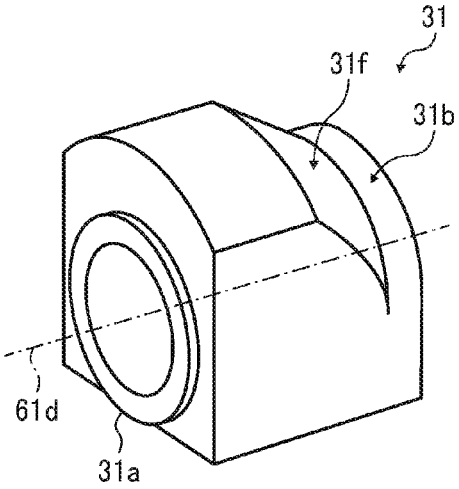
Figure 9D:
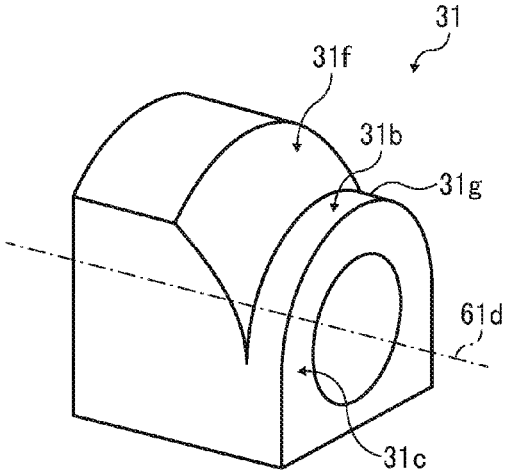

FIGS. 9A, 9B, 9C, and 9D are schematic views illustrating the shaft inclining member 31 according to the present embodiment. FIG. 9A is the schematic back view of the shaft inclining member 31 as viewed from the left in FIG. 6. FIG. 9B is the schematic side view of the shaft inclining member 31 as viewed from the front in FIG. 6. FIG. 9A is the schematic perspective view of the shaft inclining member 31 as viewed from the upper front left in FIG. 6. FIG. 9B is the schematic perspective view of the shaft inclining member 31 as viewed from the upper front right in FIG. 6.

The shaft inclining member 31 includes a belt following member contact portion 31*a*, the inclined face 31*f*, and the stopped face 31*b*. The belt following member contact portion 31*a* that contacts the belt deviation follower 30 has a cylindrical shape. The inclined face 31*f* is curved such that, when the shaft inclining member 31 is attached to the separation roller 61, the inclined face 31*f* conforms to a portion of the surface of a conical shape having a virtual axis that coincides with the rotation axis 61*d* of the separation roller 61. The stopped face 31*b* contacts the stopper face 35*d* to determine a position of the shaft inclining member 31 relative to the frame 35 in the vertical direction. The stopped face 31*b* is curved to conform to the surface of a cylindrical shape coaxial with the virtual axis.

There are two reasons for forming the inclined face 31*f* with a curved surface.

The first reason is that even when the shaft inclining member 31 rotates slightly around the separation roller shaft 61*a*, the angle of inclination of the rotation axis 61*d* of the separation roller 61 relative to the rotation axis 17*d* of the secondary transfer roller 17 does not change.

The second reason is that the curved surface of the inclined face 31*f* reduces the contact between the inclined face 31*f* and the inclined face contact portion 35*c* of the frame 35 to a point contact, thereby reducing friction at the contact place. Accordingly, the belt deviation follower 30 and the shaft inclining member 31 are smoothly movable when a force along the separation roller shaft 61*a* acts on the belt deviation follower 30 and the shaft inclining member 31. With this configuration, the contact pressure at the end portion of the secondary transfer belt 60 contacting the flange 30*a* of the belt deviation follower 30 is reduced, thereby reducing damage to the end portion of the secondary transfer belt 60 such as a crack and hence achieving extended belt life expectancy.

In the present embodiment, a slope angle γ in FIG. 5 of the inclined face 31*f* of the shaft inclining member 31 relative to the separation roller shaft 61*a* is, but is not limited to, approximately 30 degrees, and the shaft inclining member 31 is made of, but is not limited to, polyacetal (POM). The shaft inclining member 31 is not rotatable around the separation roller shaft 61*a* by the rotation stopper 47.

The restriction portion 31*g* of the shaft inclining member 31 including the stopped face 31*b* can be also used for positioning. As illustrated in FIG. 5, the frame 35 includes a guide portion 35*e* protruding inward in the axial direction of the separation roller 61. The stopped face 31*b* being positioned at an initial position is in contact with the stopper face 35*d* as a bottom face of the guide portion 35*e*. With this configuration, the inclination of the separation roller 61 in the initial state after assembling can be constant.

If the shaft inclining member 31 does not include the stopped face 31*b* and the inclined face 31*f* extends to a right end of the shaft inclining member 31 in the axial direction in FIG. 5, the inclined face 31*f* contacts the guide portion 35*e* of the frame 35 in the initial state. In this case, since there is no standard position, the separation roller 61 may be obliquely assembled. In that case, the secondary transfer belt is drawn to one side from the initial state, and the separation roller 61 is inclined. Therefore, it may take long time to converge a wander of the secondary transfer belt 60 (belt deviation). Depending on how the separation roller is assembled, for example, due to a hang-up of the shaft inclining member 31, the wander of the secondary transfer belt 60 may be out of control. Therefore, an excessive load may act on the end portion of the secondary transfer belt 60 in the width direction. In this case, the secondary transfer belt 60 may be early cracked or damaged.

The stopped face 31*b* of the shaft inclining member 31 preferably contacts stopper face 35*d* at front and back sides of the printer 100 (right and left sides in FIG. 4 or both ends in the axial direction). However, one side contact can suppress variations of an initial inclination of the separation roller 61.

The restriction portion 31*g* for positioning is also used for keeping a pushing amount of the dust-removal brush roller 152 relative to the secondary transfer belt 60.

The guide 35 has a linear corner portion that extends in the front-back direction in FIGS. 4 and 5, and the corner portion is rounded (curved), in particular, into R-shape. Since the inclined face contact portion 35*c* has the linear corner portion, even if a circumference of the secondary transfer belt 60 changes and the separation roller 61 moves in the belt travel direction due to environmental variations, the shaft inclining member 31 can keep the point contact with the guide portion 35*e* at a same height.

Next, a description is provided of the rotation stopper 47 that prevents the shaft inclining member 31 from rotating around the separation roller shaft 61*a*.

Figure 10:
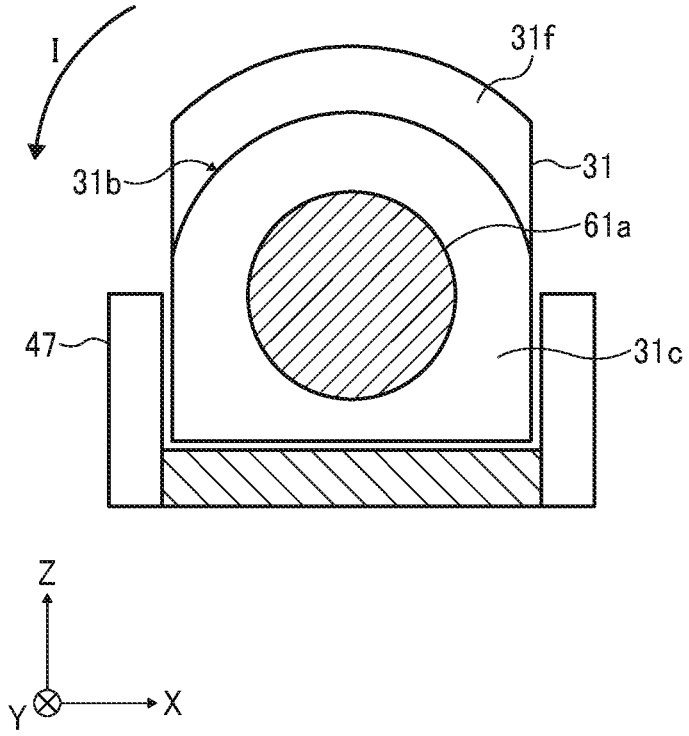
FIG. 10 is a schematic cross-sectional view of the shaft inclining member and a rotation stopper for the shaft inclining member from an axial direction, according to an embodiment.

FIG. 10 is a schematic cross-sectional view of the shaft inclining member 31 and the rotation stopper 47 viewed from right side of the axial outer end face 31*c* in FIG. 5.

As illustrated in FIG. 10, the rotation stopper 47 covers side faces and a bottom face of the shaft inclining member 31. As illustrated in FIGS. 2A, 2B, 5, and 6, the rotation stopper 47 is joined with the separation roller bearing 33.

When the separation roller shaft 61*a* rotates together with the separation roller 61, a force that rotates the shaft inclining member 31 in an x-z plain in a direction indicated by an arrow I in FIG. 10 acts on the shaft inclining member 31. However, the shaft inclining member 31 is not rotated by the force. The rotation stopper 47 does not include a portion that contacts both end faces of the shaft inclining member 31 in the axial direction (direction perpendicular to the surface of the paper on which FIG. 10 is drawn). Therefore, the shaft inclining member 31 is not prevented from moving along the axial direction by the rotation stopper 47. Accordingly, when the secondary transfer belt 60 is drawn to one side, the shaft inclining member 31 can move outward in the axial direction without rotating around the separation roller shaft 61*a*.

Since the rotation stopper 47 is joined with the separation roller bearing 33, the rotation stopper 47 moves together with the separation roller shaft 61*a* in a direction of the sliding of the separation roller bearing 33 indicated by the arrow H in FIG. 2.

The separation roller bearing 33 joined with the rotation stopper 47 is supported by the roller shaft support 34. Thus, when the roller shaft support 34 pivots in the direction indicated by the arrow G in FIG. 2 and the separation roller shaft 61*a* moves in the vertical direction, the rotation stopper 47 moves together with the separation roller shaft 61*a* in the vertical direction.

As long as the rotation stopper 47 allows the shaft inclining member 31 to move in the axial direction and prevents the shaft inclining member 31 from rotating, the shape of the rotation stopper 47 is not limited to the shape illustrated in FIG. 10.

The rotation stopper 47 may be joined with other member that moves in conjunction with the separation roller shaft 61*a* and is not limited to the rotation stopper 47 joined with the separation roller bearing 33. For example, in the above-described embodiment, the belt deviation follower 30 rotates according to the movement of secondary transfer belt 60. In a configuration in which the belt deviation follower 30 slides along the separation roller shaft 61*a* and not rotate, the rotation stopper 47 may be joined with the belt deviation follower 30.

Next, the dust-removal brush roller 152 is described.

As illustrated in FIGS. 2A and 2B, the dust-removal brush roller 152 is disposed to dig into a portion of the secondary transfer belt 60 stretched taut between the separation roller 61 and the secondary transfer roller 17. The dust-removal brush roller 152 is disposed close to the secondary transfer roller 17. More specifically, in the belt travel direction, the dust-removal brush roller 152 is disposed in contact with a portion of the secondary transfer belt 60 closer to the secondary transfer roller 17 than a center point between a downstream end of a portion of the secondary transfer belt 60 wound around the separation roller 61 and an upstream end of a portion of the secondary transfer belt 60 wound around the secondary transfer roller 17.

In other embodiment, the dust-removal brush roller 152 may be disposed in contact with a portion of the secondary transfer belt 60 wound around the secondary transfer roller 17. With this configuration, even if the separation roller 61 moves, the pushing amount of the dust-removal brush roller 152 can be kept, and a cleaning ability can be maintained.

In the secondary transfer unit 144 according to the present embodiment, the dust-removal brush roller 152 is disposed in contact with the portion of the secondary transfer belt 60 stretched taut between the separation roller 61 and the secondary transfer roller 17, because installation space is small.

Specifically, at the portion of the secondary transfer belt 60 wound around the secondary transfer roller 17, the secondary-transfer cleaning blade 151, a lubricant application brush roller 153*a*, and secondary-transfer backup roller 54 are disposed opposite the secondary transfer roller 17. Accordingly, it is difficult to dispose the dust-removal brush roller 152 opposite the secondary transfer roller 17 via the secondary transfer belt 60.

The dust-removal brush roller 152 includes a cylindrical shaft and a large number of conductive fibers made of polyethylene terephthalate (PET). The conductive fibers are fixed on the cylindrical shaft to form the dust-removal brush roller 152. A fiber thickness is 267 T/24 F×2 (decitex per filaments), which means that 2 bundle of 24 filaments (fibers) of 10000 m in length weigh 267 g. The value is proportional to a cross-sectional area of the fiber and corresponds to the fiber thickness. A thread density is 50000 filaments per square inch. An outer diameter of the dust-removal brush roller 152 is 16 mm and a length of the fibers is 4.5 mm without deformation due to biting.

In an ideal state (state illustrated in FIGS. 2A, 3, and 4) without the belt deviation of the secondary transfer belt 60, the pushing amount of the dust-removal brush roller 152 relative to the secondary transfer belt 60 is 1.4 mm.

The pushing amount of the dust-removal brush roller 152 correlates to the cleaning ability. A defective cleaning is likely to occur due to the small pushing amount. By contrast, a fiber leaning that is plastic deformation of the dust-removal brush roller 152 is likely to become greater due to the large pushing amount.

When the dust-removal brush roller 152 is disposed in contact with an area of the secondary transfer belt 60 outside the portion thereof wound around the secondary transfer roller 17, the pushing amount of the dust-removal brush roller 152 relative to the secondary transfer belt 60 is varied according to the inclination of the separation roller 61.

In the present embodiment, the dust-removal brush roller 152 is disposed downstream from the separation roller 61 but upstream from the secondary transfer roller 17 in the belt travel direction. Accordingly, the pushing amount of the dust-removal brush roller 152 relative to the secondary transfer belt 60 is varied according to the inclination of the separation roller 61.

Figure 11A:
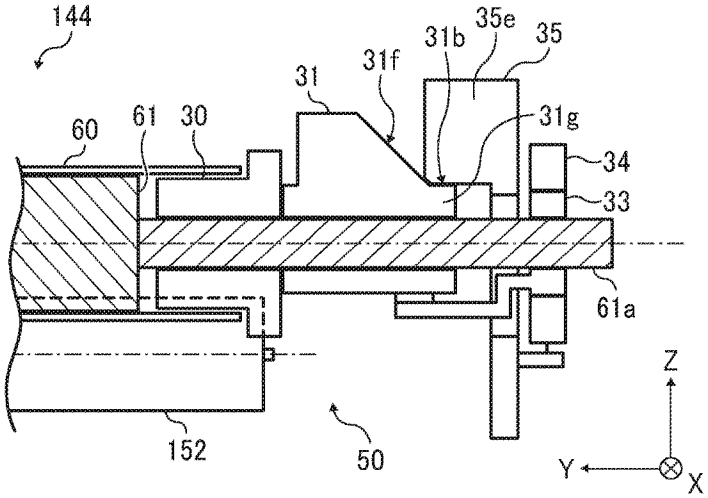
FIG. 11A is a schematic cross-sectional view of the secondary transfer unit illustrating change of pushing amount of a dust-removal brush roller relative to the secondary transfer belt in the initial state according to an embodiment.
Figure 11A:
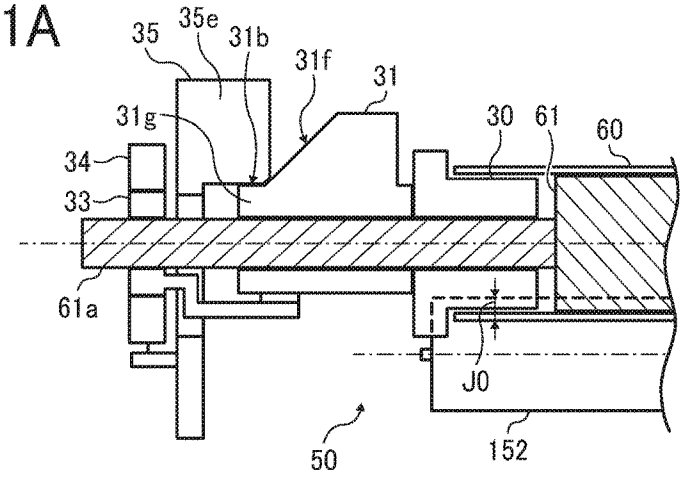
Figure 11B:
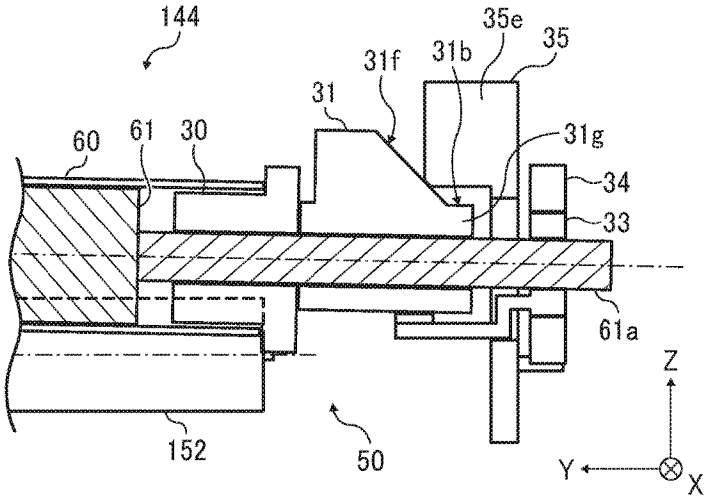
FIG. 11B is a schematic cross-sectional view of the secondary transfer unit illustrating change of pushing amount of the dust-removal brush roller relative to the secondary transfer belt in a state of belt deviation toward the front side of the secondary transfer unit according to an embodiment.
Figure 11B:
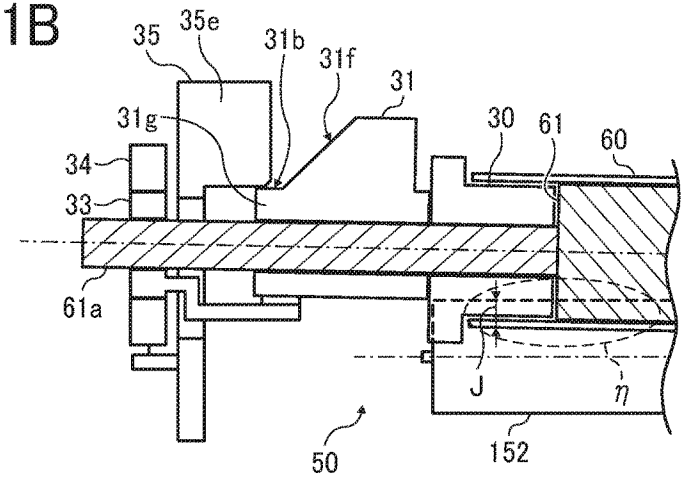

FIGS. 11A and 11B are schematic cross-sectional views of the secondary transfer unit 144 according to the present embodiment for an explanation of the change of the pushing amount of the dust-removal brush roller 152 relative to the secondary transfer belt 60. FIG. 11A is the schematic cross-sectional view of the secondary transfer unit 144 in the initial state. FIG. 11B is the schematic cross-sectional view of the secondary transfer unit 144 in the state of the belt deviation toward the front side (right side in FIG. 11B) of the secondary transfer unit 144.

Although FIG. 11A is the schematic cross-sectional view of the secondary transfer unit 144 at the same cross section in FIG. 4, only cross sections of the separation roller 61 and separation roller shaft 61*a* are hatched in FIG. 11A for convenience of explanation. In addition, the dust-removal brush roller 152 elastically deforms along the secondary transfer belt 60. The broken lines of the perimeter of the dust-removal brush roller 152 in FIGS. 11A and 11B indicate the virtual area of the dust-removal brush roller 152 when the dust-removal brush roller 152 does not elastically deforms. A dash-single-dot line indicates rotation axes of the separation roller 61 and the dust-removal brush roller 152 in FIGS. 11A and 11B.

Figure 12:
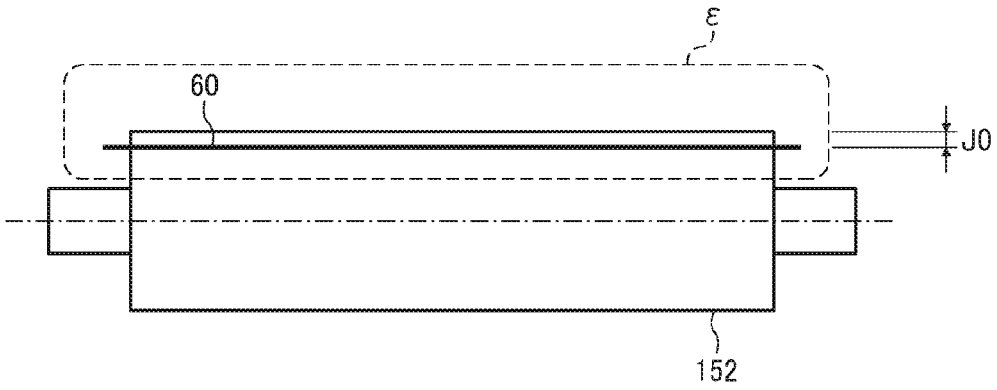
FIG. 12 is a schematic diagram illustrating the initial pushing amount of the dust-removal brush roller relative to the secondary transfer belt according to an embodiment.

FIG. 12 is schematic diagram the amount of the pushing amount of the dust-removal brush roller 152 relative to the secondary transfer belt 60 in the initial state (hereinafter, "an initial pushing amount J0").

Figure 13A:
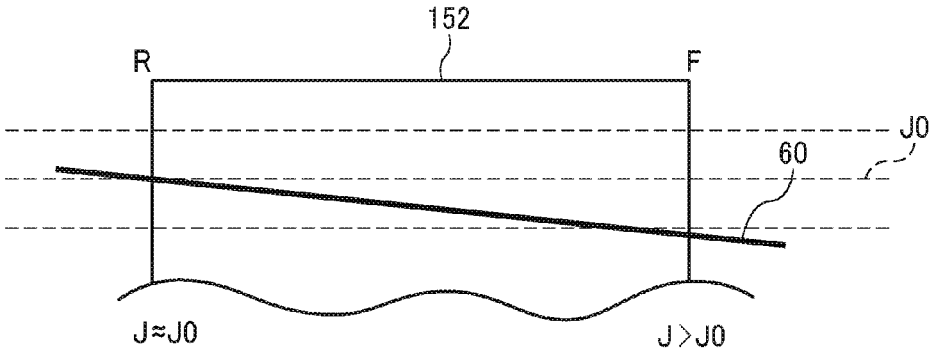
FIG. 13A is a schematic enlarged diagram of an area Π in FIG. 12 according to an embodiment illustrating the pushing amount of the dust-removal brush roller relative to the secondary transfer belt in a state of the belt deviation toward the front side of the secondary transfer unit.
Figure 13B:
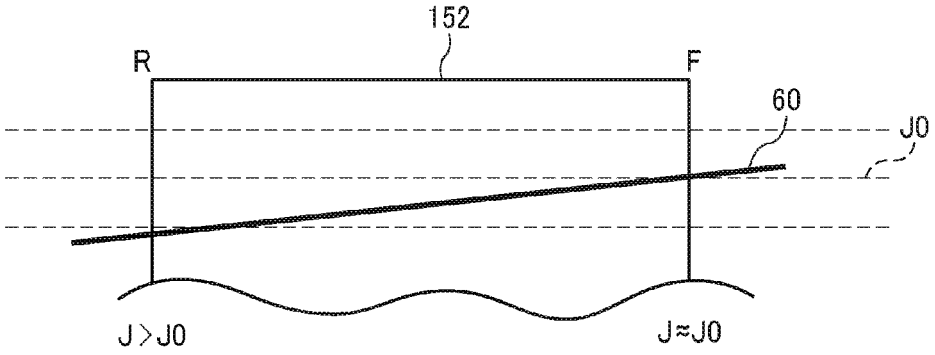
FIG. 13B is a schematic enlarged diagram of the area Π in FIG. 12 according to an embodiment illustrating the pushing amount of the brush roller relative to the secondary transfer belt in a state of the belt deviation toward the rear side of the secondary transfer unit.

FIGS. 13A and 13B are schematic enlarged diagrams of an area Π in FIG. 12 according to the present embodiment in a state of the belt deviation. In FIGS. 13A and 13B, F represents a front side end of the secondary transfer unit 144, and R represents a rear side end of the secondary transfer unit 144. The secondary transfer unit 144 in FIG. 13A is in the state of the belt deviation toward the front side thereof, and the secondary transfer unit in FIG. 13B is in the state of the belt deviation toward the rear side thereof.

Figure 14A:
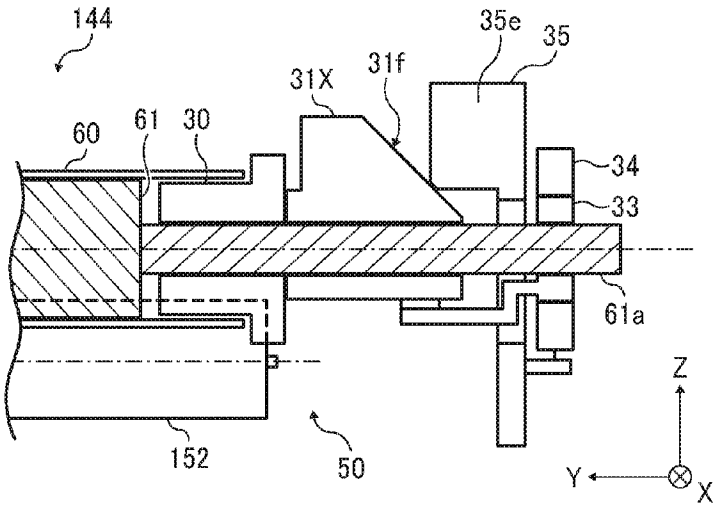
FIG. 14A is a schematic cross-sectional view of the secondary transfer unit illustrating change of pushing amount of the dust-removal brush roller relative to the secondary transfer belt in the initial state according to a comparative example.
Figure 14A:
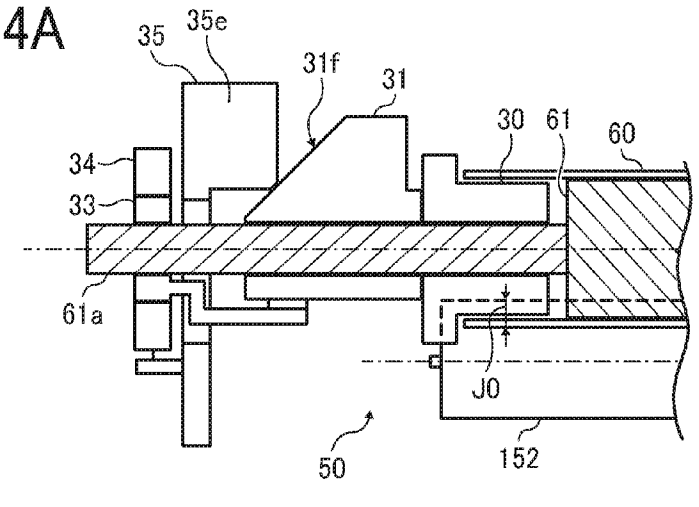
Figure 14B:
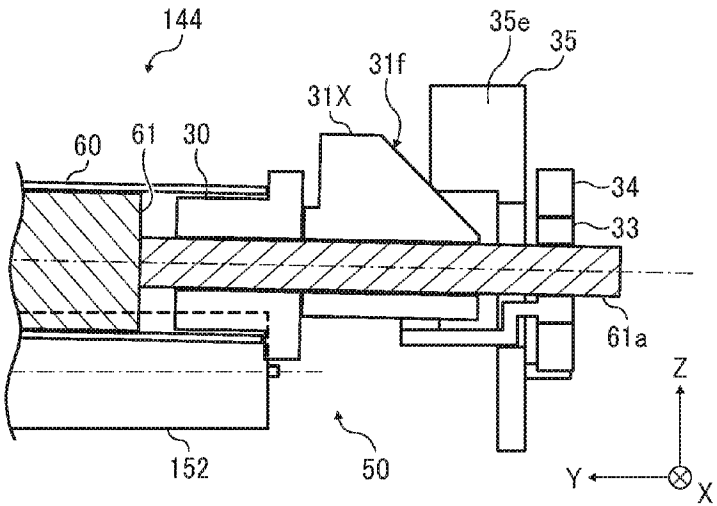
FIG. 14B is a schematic cross-sectional view of the secondary transfer unit illustrating change of pushing amount of the dust-removal brush roller relative to the secondary transfer belt in a state of belt deviation toward the front side of the secondary transfer unit according to the comparative example.
Figure 14B:
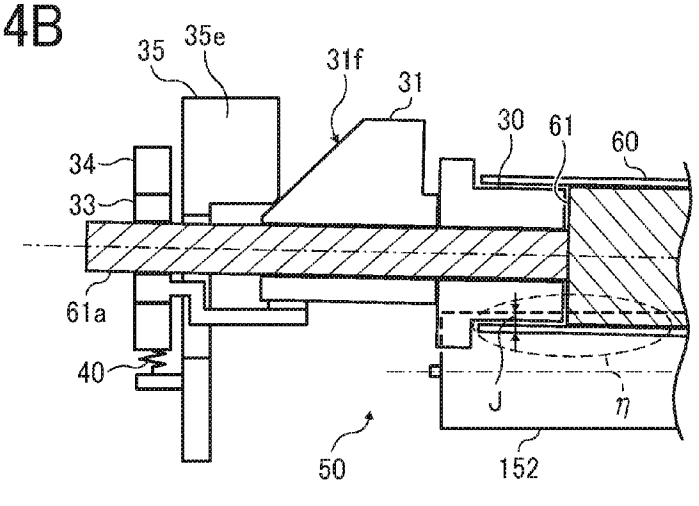

FIGS. 14A and 14B are schematic cross-sectional views of the secondary transfer unit 144 including a shaft inclining member 31X does not include the restriction portion 31*g* as a pushing amount retainer according to a comparative example for an explanation of the change of the pushing amount of the dust-removal brush roller 152 relative to the secondary transfer belt 60. FIG. 14A is the schematic cross-sectional view of the secondary transfer unit 144 in the initial state. FIG. 14B is the schematic cross-sectional view of the secondary transfer unit 144 in the state of the belt deviation toward the front side (right side in FIG. 14B) of the secondary transfer unit 144. The comparative example has a similar configuration of the present embodiment described above except that the shaft inclining member 31X does not include the restriction portion 31*g* having the stopped face 31*b*.

Figure 15A:
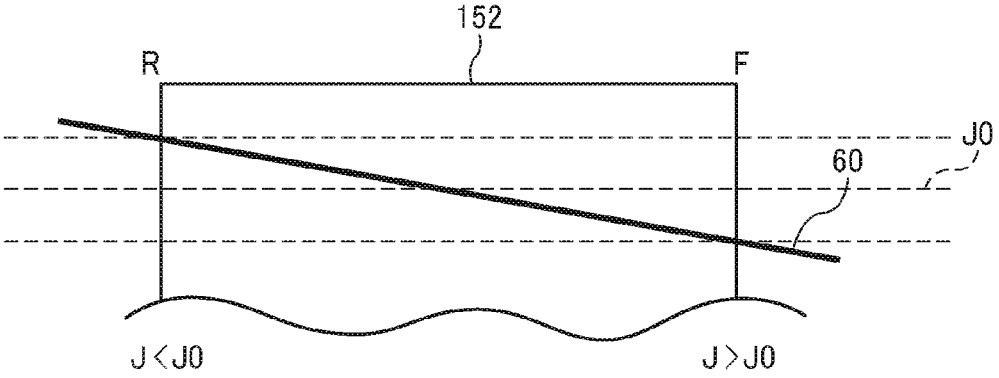
FIG. 15A is a schematic enlarged diagram of the area Π in FIG. 12 according to the comparative example illustrating the pushing amount of the brush roller relative to the secondary transfer belt in a state of belt deviation toward the front side of the secondary transfer unit.
Figure 15B:
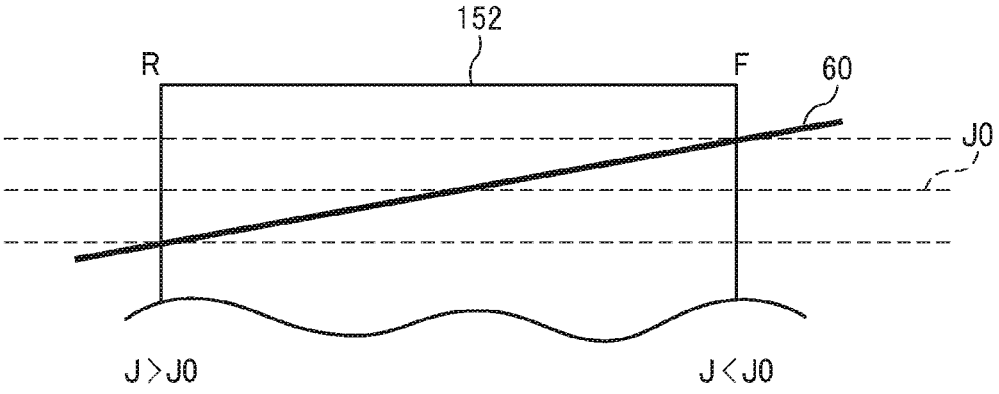
FIG. 15B is a schematic enlarged diagram of the area ε in FIG. 12 according to the comparative example illustrating the pushing amount of the brush roller relative to the secondary transfer belt in a state of belt deviation toward the rear side of the secondary transfer unit.

FIGS. 15A and 15B are schematic enlarged diagrams of an area ε in FIG. 12 according to the comparative example in a state of the belt deviation. In FIGS. 15A and 15B, F represents a front side end of the secondary transfer unit 144, and R represents a rear side end of the secondary transfer unit 144. The secondary transfer unit in FIG. 15A is in the state of the belt deviation toward the front side thereof, and the secondary transfer unit in FIG. 15B is in the state of the belt deviation toward the rear side thereof.

In the comparative example, in the state of the belt deviation toward the front side of the secondary transfer unit 144, the shaft inclining member 31X on the front side moves downward by the similar configuration correcting the belt deviation in the present embodiment described above. In the secondary transfer unit 144 according to the comparative example, the shaft inclining member 31X can move upward from an initial position illustrated in FIG. 14A because of the absence of the restriction portion 31*g*. Therefore, as illustrated in FIG. 14B, the shaft inclining member 31X on the front side may move downward, and the shaft inclining member 31X on the rear side may move upward. In the direction perpendicular to the axis of the separation roller shaft 61*a*, since the shaft inclining member 31X moves with the separation roller shaft 61*a*, as the rear side of the shaft inclining member 31X moves upward, the separation roller shaft 61*a* moves upward as well. Accordingly, the separation roller 61 also moves upward, and the portion of the secondary transfer belt 60 stretched taut between the separation roller 61 and the secondary transfer roller 17 moves upward as well.

With this displacement, the pushing amount of the dust-removal brush roller 152 relative to the secondary transfer belt 60 decrease in an area η on the rear side (area η in FIG. 14B).

In the comparative example, as illustrated in FIG. 15A, in the state of the belt deviation toward the front side of the secondary transfer unit 144, the pushing amount J on the front side is larger than the initial pushing amount J0 at the initial state, and the pushing amount J on the rear side is smaller than the initial pushing amount J0. In the comparative example, as illustrated in FIG. 15B, in the state of the belt deviation toward the rear side of the secondary transfer unit 144, the pushing amount J on the front side is smaller the initial pushing amount J0, and the pushing amount J on the rear side is larger than the initial pushing amount J0.

As illustrated in the comparative example, during belt deviation correction, as the pushing amount of the dust-removal brush roller 152 relative to the secondary transfer belt 60 becomes smaller than the initial pushing amount J0, the cleaning ability deteriorates.

By contrast, the secondary transfer unit 144 according to the present embodiment includes the shaft inclining member 31 with the restriction portion 31*g* as the pushing amount retainer.

The stopped face 31*b* of the restriction portion 31*g* contacts the stopper face 35*d* of the frame 35 to prevent the shaft inclining member 31 from moving upward from the initial position that defines the initial pushing amount J0. The restriction portion 31*g* is disposed at an axial end of the shaft inclining member 31 disposed outside the separation roller 61 in the axial direction.

In the secondary transfer unit 144 according the present embodiment, in the state of the belt deviation toward the front side of the secondary transfer unit 144, the shaft inclining member 31 on the front side moves downward by the above-described configuration correcting the belt deviation. As illustrated in FIG. 11B, the shaft inclining member 31 on the front side move downward, but the shaft inclining member 31 on the rear side does not move upward because the secondary transfer unit 144 according to the present embodiment includes the restriction portion 31*g*. Accordingly, the separation roller shaft 61*a* does not move upward, and the secondary transfer belt 60 stretched taut between the separation roller 61 and the secondary transfer roller 17 does not move upward as well.

Because the separation roller 61 does not move upward from the initial position, the pushing amount of the dust-removal brush roller 152 relative to the secondary transfer belt 60 is prevented from decreasing in the area on the rear side (area η in FIG. 11B).

In the present embodiment, as illustrated in FIG. 13A, in the state of the belt deviation toward the front side of the secondary transfer unit 144, the pushing amount J on the front side is larger than that of the initial state J0, and the pushing amount J on the rear side hardly changes from the initial state J0. In the present embodiment, as illustrated in FIG. 13B, in the state of the belt deviation toward the rear side of the secondary transfer unit 144, the pushing amount J on the front side does not substantially change from that of the initial state J0, and the pushing amount J on the rear side is larger than that of the initial state J0.

The belt alignment unit 50 to correct belt position according to the belt deviation prevents stress at the end of the secondary transfer belt 60 in the width direction and suppresses the crack at the end of the secondary transfer belt 60 in the width direction. Accordingly, the crack of the end of the secondary transfer belt 60 is suppressed to expand the life expectancy of the secondary transfer belt 60.

In the belt alignment unit 50 according to the present embodiment, when the secondary transfer belt 60 is drawn to one side, the shaft inclining member 31 having the inclined face 31*f* moves downward along the guide portion 35*e* of the frame 35 to incline the separation roller 61. At that time, the behavior of the other side of the secondary transfer belt 60 depends on whether or not the pushing amount retainer like the restriction portion 31*g* is provided.

In the belt alignment unit 50 with the pushing amount retainer according to the present embodiment, the pushing amount retainer prevents an inclined support rotator (e.g. the separation roller 61) from moving in a direction to reduce the pushing amount. Thus, the pushing amount does not decrease.

On the other hand, in the belt alignment unit 50 without the pushing amount retainer according to the comparative example, the inclined face 31*f* of the shaft inclining member 31 contacts the guide portion 35*e*, and an inclined support rotator (separation roller 61) may move in a direction to reduce the pushing amount. Accordingly, when the secondary transfer belt 60 is drawn to one side, the inclined support rotator moves in the direction to reduce the pushing amount, and the pushing amount may decrease.

In the belt alignment unit 50 with the pushing amount retainer according to the present embodiment, when the belt deviation is corrected, the separation roller 61 as the inclined support rotator moves only in a direction to increase the pushing amount compared with the initial state. Thus, the pushing amount of the dust-removal brush roller 152 relative to the secondary transfer belt 60 increases compared with the initial state before the belt alignment, and the cleaning ability does not deteriorate. Therefore, in the secondary transfer unit 144 according to the present embodiment, both an extending the life expectancy of the secondary transfer belt 60 and a maintaining the cleaning ability by the dust-removal brush roller 152 are attained.

In the belt alignment unit 50 with the pushing amount retainer like the restriction portion 31*g* according to the present embodiment, when the belt deviation is corrected, the pushing amount of dust-removal brush roller 152 does not decrease compared with the initial state.

In the present embodiment, the restriction portion 31*g* as the pushing amount retainer is a part of the shaft inclining member 31, and, as illustrated in FIG. 9, the top face of the restriction portion 31*g* is curved and a part of the cylindrical shape. The pushing amount retainer may be a part of another member instead of the shaft inclining member 31. Additionally, the pushing amount retainer is not limited to the part of the cylindrical shape as long as the pushing amount is maintained.

Next, an upper limit of the pushing amount of the dust-removal brush roller 152 is described.

If the pushing amount is too large, the fiber leaning (plastic deformation) of the dust-removal brush roller 152 occurs. Since the fiber leaning reduces the cleaning ability, an upper limit of the pushing amount is preferably set. In the present embodiment, if the pushing amount is larger than or equal to two thirds of the length of fiber of the dust-removal brush roller 152, the fiber leaning becomes unacceptably worse. Therefore, in the present embodiment, the upper limit of the pushing amount is set to less than or equal to two third of the length of fiber of the dust-removal brush roller 152 (3 mm) as a predetermined value. Setting the upper limit of the pushing amount is attained by an arrangement of the dust-removal brush roller 152 or a restriction of the inclination amount of the rotation axis 61*d* of the separation roller 61 relative to the rotation axis 17*d* of the secondary transfer roller 17.

In the secondary transfer belt 60, as the position approaches the portion wound around the secondary transfer roller 17, the displacement of the secondary transfer belt 60 by inclination of the separation roller 61 decreases. Accordingly, a variation of the pushing amount of the dust-removal brush roller 152 can be suppressed, and the pushing amount can be kept within the upper limit. In the present embodiment, as described above, the dust-removal brush roller 152 is disposed in contact with the secondary transfer belt 60 close to the secondary transfer roller 17. Therefore, the pushing amount can be prevented from becoming too large, and deterioration of the cleaning ability caused by the fiber leaning can be suppressed.

Additionally, the larger the inclination angle α of the rotation axis 61*d* of the separation roller 61 relative to the rotation axis 17*d* of the secondary transfer roller 17 is, the larger the displacement of the secondary transfer belt 60 is, and the pushing amount of the dust-removal brush roller 152 becomes larger. The inclination angle α is controlled to prevent the pushing amount from becoming too large, and deterioration of the cleaning ability caused by the fiber leaning can be suppressed.

The secondary-transfer cleaning blade 151 is described below.

The secondary-transfer cleaning blade 151 is made of urethane rubber. A rubber hardness of a contact portion to the secondary transfer belt 60 is 80 (Shore A). A rubber hardness is not limited to this value. Higher rubber hardness is desirable because a blade deformation is suppressed. If the rubber hardness is too high, the secondary-transfer cleaning blade 151 does not conform to an unevenness of the secondary transfer belt 60. Thus, the defective cleaning is likely to occur. Too high rubber hardness also causes a crack of the secondary-transfer cleaning blade 151. Therefore, it is desirable to use adequate rubber hardness for a belt device system.

The lubricant applicator 153 is described below.

In the secondary transfer unit 144 according to the present embodiment, lubricant is applied to the secondary transfer belt 60 in order to prevent filming on the surface of the secondary transfer belt 60 or the deformation of the secondary-transfer cleaning blade 151. The lubricant applicator 153 includes a lubricant application brush roller 153*a* and a solid lubricant 153*b*. The solid lubricant 153*b* is pressed against the lubricant application brush roller 153*a*, and the lubricant application brush roller 153*a* rubs the solid lubricant 153*b* and applies the lubricant to the secondary transfer belt 60.

In the present embodiment, the lubricant is applied to the secondary transfer belt 60 in order to reduce a friction coefficient of the secondary transfer belt 60, thereby preventing an adhesion of foreign substances. With this configuration, a filming that is adhesion of foreign substances is suppressed, and the dust-removal brush roller 152 or the secondary-transfer cleaning blade 151 can easily remove foreign substances.

The lubricant application brush roller 153*a* is made of polyethylene terephthalate (PET). A diameter of the lubricant application brush roller 153*a* is 13.5 mm, and the pushing amount relative to the secondary transfer belt 60 is 1 mm. The solid lubricant 153*b* in the present embodiment includes zinc stearate. The lubricant application brush roller 153*a* or the solid lubricant 153*b* is not limited to above-described configurations or conditions. It is desirable to select the most suitable one depending on a system.

The secondary transfer unit 144 according to the present embodiment includes the dust-removal brush roller 152 in addition to the secondary-transfer cleaning blade 151 and the lubricant applicator 153. Accordingly, the defective cleaning caused by dust is prevented. The dust comes from the recording medium P such as a transfer paper that is conveyed with the secondary transfer belt 60.

The dust-removal brush roller 152 alone can remove foreign substances such a toner adhered on the secondary transfer belt 60 to a certain extent. However, a large amount of toner input that the dust-removal brush roller 152 alone does not remove may cause the defective cleaning. In the present embodiment, foreign substances that the dust-removal brush roller 152 alone does not remove are removed by the secondary-transfer cleaning blade 151. Thus, a large amount of toner input does not cause the defective cleaning.

In the present embodiment, the secondary-transfer cleaning blade 151 and the lubricant applicator 153 are disposed in the area of the secondary transfer belt 60 wound around the secondary transfer roller 17. The secondary transfer roller 17 is a non-inclined roller. The relative position of the secondary-transfer cleaning blade 151 or the lubricant applicator 153 relative to the secondary transfer belt 60 does not change. Accordingly, removal of foreign substances and lubricant application are steadily performed.

In the rotator inclination unit according to the present embodiment, the separation roller 61 as an inclined support rotator is inclined by drawing force of the secondary transfer belt 60 to one side. The rotator inclination unit supports the separation roller 61 so as to change an axial alignment of the separation roller 61 relative to the secondary transfer roller 17. The belt alignment is automatically corrected by using the belt drawing force without a driving source such as a motor to incline the separation roller 61.

In the secondary transfer unit 144 that maintains the pushing amount of the dust-removal brush roller 152 relative to the secondary transfer belt 60, the rotator inclination unit for the separation roller 61 is not limited to the configuration using the belt drawing force. the rotator inclination unit using an actuator such as a motor can be used. The separation roller 61 as a steering roller is inclined by the actuator. With this configuration, a belt deviation detector detects belt deviation. The actuator is controlled by the detected result to correct the belt deviation. A pushing amount retainer is employed that limits a direction to which an end of the separation roller shaft 61*a* is displaced by the actuator to downward. With this configuration, the pushing amount of the dust-removal brush roller 152 can be kept, and cleaning ability can be maintained.

The present embodiment does not need the actuator because the separation roller is inclined by using the belt drawing force. Therefore, this configuration can reduce cost and weight of the unit. In addition, this configuration allows miniaturization of the unit because there is no need for space to dispose the actuator.

In the above-described embodiment, the configuration in which the cleaner is the brush roller is described. The cleaner is not limited to the brush roller. A cleaner whose cleaning ability changes according to the pushing amount relative to the belt, such as a sponge roller and a flexible blade, can be adaptable.

The printer 100 is the color image forming apparatus using an electrophotographic method in which toner images of different colors formed on the photoconductors 1 as latent image bearers are primarily transferred onto the intermediate transfer belt 3 as an intermediate transferor in a primary transfer process and then onto a recording medium P in a secondary transfer process. There are two types of secondary transfer devices that performs the secondary transfer process employed in the image forming apparatus of this kind: a roller-transfer type and a belt-transfer type. The secondary transfer device of the roller-transfer type includes an intermediate transferor and a transfer roller. The recording medium P is interposed and transported between the intermediate transferor and the transfer roller. The toner image is secondarily transferred onto the recording medium P while the recording medium P is transported. The secondary transfer device of the belt-transfer type includes a conveyor belt (i.e., a secondary transfer belt) formed into an endless loop entrained about and stretched taut between support rollers. The recording medium P is interposed between the conveyor belt and the intermediate transferor, and the toner image is secondarily transferred onto the recording medium P while the recording medium P is transported.

In the secondary transfer device of the belt-transfer type, the recording medium P is interposed in a secondary transfer nip between the secondary transfer belt and the intermediate transferor, and the recording medium P is absorbed to the secondary transfer belt upstream and/or downstream from the secondary transfer nip in the transport direction of the recording medium P. In this configuration, the recording medium P is held and transported reliably, not only at the secondary transfer nip, but also at the upstream side and the downstream side in the transport direction of the recording medium P. For this reasons, it is generally said that the belt-transfer type allows more reliable recording medium conveyance than the roller-transfer type.

In the belt-transfer type, like general belt conveyance devices, the secondary transfer belt may drift to one side in a width direction of the secondary transfer belt (belt deviation) or repeatedly wander back and forth on either side in the width direction of the belt. The belt deviation (including belt walk) is attributed to dimensional tolerances of parts constituting the secondary transfer device, for example, variations in a parallelism error of rotary shafts of the plurality of support rollers that supports the secondary transfer belt, variations in an outer diameter of the rollers, and variations in tension of the secondary transfer belt due to changes in the circumferential length of the secondary transfer belt itself.

Specifically, for those reasons, the secondary transfer belt does not travel linearly but travels in a state of displacement in the axial direction of the support roller (width direction of the belt). Accordingly, the secondary transfer belt is drawn to one side in a direction of the displacement.

Especially, in a small secondary transfer device, since a distance between axes of the support rollers is short, dimensional tolerances of the support roller are likely affect the belt deviation. Therefore, there is demand for minimizing belt deviation.

Various belt deviation restriction units have been proposed to keep the belt travel range (belt deviation range) within a certain range. Some belt deviation restriction units restrict the belt movement in the width direction beyond the certain range. Other belt deviation restriction units correct the belt deviation by a force acting on the belt to move in the opposite direction of the belt deviation. The secondary transfer unit 144 according to the present embodiment utilizes a force acting on the belt to move in the opposite direction of the belt deviation.

In the above-described embodiment, the configuration of the secondary transfer device (secondary transfer unit 144) is described in which the cleaner contacts the secondary transfer belt supported by the plurality of the support rollers including the inclined support rotator. The belt device including the pushing amount retainer configured to maintain the pushing amount of the cleaner is not limited to the secondary transfer device. For example, the belt device according to the present embodiment is adaptable for an intermediate transfer device (intermediate transfer unit 145 according to the present embodiment) in order to correct the belt deviation of the intermediate transfer belt. Furthermore, the belt device according to the present embodiment is adaptable for various belt devices such as a conveyor belt that convey materials or products at a factory as well as the belt device in the image forming apparatus.

The structures described above are just examples, and the various aspects of the present specification provide respective effects as follows.

Aspect A

A belt device such as the secondary transfer unit 144 includes a plurality of support rotators such as the separation roller 61 and the secondary transfer roller 17, a belt such as the secondary transfer belt 60, a cleaner such as the dust-removal brush roller 152, and a rotator inclination unit such as the belt alignment unit 50. The belt is looped around the plurality of support rotators and moves according to rotation of the plurality of support rotators. The cleaner contacts a surface of the belt to remove foreign substances. The rotator inclination unit inclines at least one of the plurality of support rotators that is an inclined support rotator such as the separation roller 61 relative to another support rotator such as the secondary transfer roller 17. The cleaner is disposed in contact with a portion of the belt stretched taut between the inclined support rotator and the another support rotator. A pushing amount of the cleaner relative to the belt is smallest in a state in which the inclined support rotator is not inclined by the rotator inclination unit.

With this configuration, as described above, a layout flexibility of the cleaner improves, and a cleaning ability of the cleaner is maintained when the inclined support rotator is inclined from the following factors.

The cleaner is disposed in contact with the portion of the belt stretched taut. Compared with a disposition of the cleaner in contact with a portion of the belt wound around another roller, the layout flexibility improves. As the inclined support rotator is inclined by the rotator inclination unit, the portion of the belt stretched taut between the inclined support rotator and the another support rotator moves. Accordingly, the pushing amount of the cleaner changes, and the cleaning ability changes. In the aspect A, the pushing amount of the cleaner is smallest in the state in which the inclined support rotator is not inclined. As the inclined support rotator is inclined, the pushing amount increases. Therefore, as the inclined support rotator is inclined by the rotator inclination unit, the portion of the belt stretched taut between the inclined support rotator and the another support rotator moves. However, the pushing amount of the cleaner can be maintained, and the cleaning ability can be maintained.

Aspect B

In the belt device according to the aspect A, the cleaner such as the dust-removal brush roller 152 contacts the belt such as the secondary transfer belt 60 at a position closer to the another support rotator than a center between a downstream end of a portion of the belt wound around the inclined support rotator such as the separation roller 61 and an upstream end of a portion of the belt wound around the another rotator such as the secondary transfer roller 17 in a belt travel direction.

As described above in the present embodiment, the pushing amount can be prevented from becoming too large, and deterioration of the cleaning ability caused by the fiber leaning can be suppressed.

Aspect C

In the belt device according to the aspect A, the rotator inclination unit is a belt alignment unit 50 configured to move an axial end of the inclined support rotator such as the separation roller 61 to control belt deviation.

As described above, in the belt device such as the secondary transfer unit 144 including the belt alignment unit 50 according to the present embodiment, the cleaning ability of the cleaner can be maintained when the inclined support rotator is inclined Aspect D In the belt device according to the aspect A, a pushing amount retainer such as the restriction portion 31*g* is configured to prevent the pushing amount of the cleaner such as the dust-removal brush roller 152 relative to the belt such as the secondary transfer belt 60 from becoming smaller than the pushing amount in the state in which the inclined support rotator such as the separation roller 61 is not inclined (initial state).

With this configuration, as described above in the present embodiment, the cleaning ability of the cleaner is maintained when the inclined support rotator is inclined.

Aspect E

In the belt device according to the aspect A, an upper limit is set for an inclination angle $\alpha$ of a rotation axis of the inclined support rotator such as the separation roller 61 relative to a rotation axis of the another support rotator such as the secondary transfer roller 17 so that the pushing amount is less than or equal to a predetermined value.

As described above in the present embodiment, the deterioration of the cleaning ability caused by the plastic deformation of the cleaner (dust-removal brush roller 152) such as the fiber leaning can be suppressed.

Aspect F

In the belt device according to the aspect A, the cleaner is a brush roller such as the dust-removal brush roller 152.

With this configuration, as described above in the present embodiment, the layout flexibility of the brush roller improves, and the cleaning ability of the cleaner is maintained when the inclined support rotator is inclined.

Aspect G

In the belt device according to the aspect F, the upper limit is set for the inclination angle of the rotation axis of the inclined support rotator such as the separation roller 61 relative to the rotation axis of the another support rotator such as the secondary transfer roller 17 so that the pushing amount of the brush roller such as the dust-removal brush roller 152 relative to the belt such as the secondary transfer belt 60 is less than or equal to two thirds of a length of a fiber of the brush roller.

As described above in the present embodiment, the deterioration of the cleaning ability caused by the plastic deformation of the cleaner (dust-removal brush roller 152) such as the fiber leaning can be suppressed.

Aspect H

In the belt device according to the aspect F, a cleaning blade such as the secondary-transfer cleaning blade 151 is configured to contact the belt such as the secondary transfer belt 60 and remove foreign substances, and a lubricant applicator 153 is configured to apply a lubricant. The lubricant applicator 153 includes a lubricant application brush roller 153*a* configured to contact the belt to apply a lubricant. The cleaning blade and the lubricant applicator are disposed downstream from the brush roller such as the dust-removal brush roller 152 in the belt travel direction.

As described above in the present embodiment, the cleaning blade in addition to the brush roller prevents the defective cleaning as compared with the brush roller alone configuration.

Aspect I

A transfer device such as the secondary transfer unit 144 includes the belt device according to the aspect A. the belt serves as a transfer belt such as the secondary transfer belt 60 configured to bear a recording medium P on a surface of the transfer belt. A visible image such as a toner image on an image bearer such as the intermediate transfer belt 3 is transferred onto the recording medium P.

With this configuration, as described above in the present embodiment, the layout flexibility of the cleaner around the transfer belt improves, and the cleaning ability of the cleaner is maintained when the inclined support rotator is inclined.

Aspect J

An image forming apparatus such as the printer 100 includes the belt device according to the aspect A configured to serve as a belt driving mechanism.

With this configuration, as described above in the present embodiment, the layout flexibility of the cleaner around the belt improves, and the cleaning ability of the cleaner is maintained when the inclined support rotator is inclined.

The above-described embodiments are illustrative and do not limit the present disclosure. Thus, numerous additional modifications and variations are possible in light of the above teachings. For example, elements and/or features of different illustrative embodiments may be combined with each other and/or substituted for each other within the scope of the present disclosure.

What is claimed is:

1. A belt device comprising:

a plurality of support rotators including an inclined support rotator;

a belt looped around the plurality of support rotators and rotated by rotation of the plurality support rotators;

a cleaner to contact a surface of the belt; and a rotator inclination unit to incline the inclined support rotator relative to a fixed axis of one of the plurality of support rotators and transverse to the belt, wherein the cleaner is disposed in contact with a portion of the belt stretched taut between the inclined support rotator and another support rotator of the plurality of support rotators that is not inclined by the rotator inclination unit, and wherein a pushing amount of the cleaner relative to the belt varies according to inclination of the inclined support rotator and is smallest in a state in which the inclined support rotator is not inclined by the rotator inclination unit.

2. The belt device according to claim 1, wherein the cleaner contacts the belt at a position closer to the another support rotator than a center between a portion of the belt wound around the inclined support rotator and a portion of the belt wound around the another support rotator in a belt travel direction.

3. The belt device according to claim 1, wherein the rotator inclination unit is a belt alignment unit to move an axial end of the inclined support rotator to correct a belt deviation.

4. The belt device according to claim 1 further comprising a pushing amount retainer to prevent the pushing amount of the cleaner from becoming smaller than the pushing amount in the state in which the inclined support rotator is not inclined.

5. The belt device according to claim 1, wherein an upper limit of an inclination angle of a rotation axis of the inclined support rotator relative to a rotation axis of the another support rotator is set to keep the pushing amount less than or equal to a predetermined value.

6. The belt device according to claim 1, wherein the cleaner is a brush roller.

7. The belt device according to claim 6, wherein an upper limit of an inclination angle of a rotation axis of the inclined support rotator relative to a rotation axis of the another support rotator is set to keep the pushing amount of the brush roller relative to the belt less than or equal to two thirds of a length of a fiber of the brush roller.

8. The belt device according to claim 6 further comprising:

a cleaning blade to contact the belt and remove foreign substances; and a lubricant applicator to contact the belt and apply a lubricant to the belt, wherein the cleaning blade and the lubricant applicator are disposed downstream from the brush roller in a belt travel direction.

9. A transfer device comprising the belt device according to claim 1, wherein the belt is a transfer belt to bear a recording medium onto which a visible image is to be transferred.

10. An image forming apparatus comprising the belt device according to claim 1.

* * * * *